US010030479B2

(12) United States Patent
Johnson et al.

(10) Patent No.: US 10,030,479 B2
(45) Date of Patent: Jul. 24, 2018

(54) TOOL FOR OPENING AND CLOSING SLEEVES WITHIN A WELLBORE

(71) Applicant: NCS MULTISTAGE INC., Calgary (CA)

(72) Inventors: Tim Johnson, Calgary (CA); Don Getzlaf, Calgary (CA)

(73) Assignee: NCS Multistage Inc., Calgary (CA)

( * ) Notice: Subject to any disclaimer, the term of this patent is extended or adjusted under 35 U.S.C. 154(b) by 246 days.

(21) Appl. No.: 14/982,820

(22) Filed: Dec. 29, 2015

(65) Prior Publication Data

US 2016/0251939 A1 Sep. 1, 2016

Related U.S. Application Data

(60) Provisional application No. 62/097,245, filed on Dec. 29, 2014.

(51) Int. Cl.

| | |
|---|---|
| ***E21B 34/14*** | (2006.01) |
| ***E21B 17/10*** | (2006.01) |
| *E21B 34/00* | (2006.01) |
| *E21B 34/06* | (2006.01) |

(52) U.S. Cl.

CPC ..... *E21B 34/14* (2013.01); *E21B 17/1078* (2013.01); *E21B 34/00* (2013.01); *E21B 34/06* (2013.01); *E21B 2034/007* (2013.01)

(58) Field of Classification Search

CPC .... E21B 34/14; E21B 2034/007; E21B 34/00; E21B 34/06; E21B 34/10; E21B 17/1078; E21B 34/063; E21B 43/20; E21B 43/26; E21B 43/267; E21B 23/006; E21B 43/12

See application file for complete search history.

(56) References Cited

U.S. PATENT DOCUMENTS

| | | | | |
|---|---|---|---|---|
| 3,457,994 | A * | 7/1969 | Stachowiak | E21B 33/1294 166/125 |
| 4,671,354 | A | 6/1987 | Henderson et al. | |
| 4,702,313 | A | 10/1987 | Greenlee et al. | |
| 4,862,961 | A | 9/1989 | Neff | |
| 4,971,146 | A | 11/1990 | Terrell | |
| 5,829,531 | A | 11/1998 | Hebert et al. | |
| 2008/0257558 | A1 * | 10/2008 | Darnell | E21B 34/103 166/373 |

(Continued)

*Primary Examiner* — Yong-Suk Ro

(74) *Attorney, Agent, or Firm* — Ridout & Maybee LLP

(57) ABSTRACT

A bottomhole assembly for deployment within a wellbore is disclosed. The wellbore string includes a port and a flow control member, wherein the latter is displaceable to open and close the port. The flow control member comprises a first mandrel; a second mandrel including a locator for disposition within a locate profile of the wellbore string to resist displacement of the second mandrel, relative to the locate profile, and locating the bottomhole assembly within the wellbore string. A shifting tool is disclosed, the shifting tool including two gripper surfaces; and two shifting tool actuators, translatable with the first mandrel. The shifting tool actuators displace the shifting tool by displacing the first mandrel downhole or uphole relative to the second mandrel; and the second mandrel includes a retainer for limiting displacement of the shifting tool, relative to second mandrel, in both of downhole and uphole directions.

88 Claims, 19 Drawing Sheets

(56) References Cited

U.S. PATENT DOCUMENTS

| | | | | |
|---|---|---|---|---|
| 2011/0203809 | A1* | 8/2011 | Knobloch, Jr. ..... | E21B 21/103<br>166/386 |
| 2014/0014360 | A1* | 1/2014 | Wilson ..... | E21B 21/103<br>166/373 |

* cited by examiner

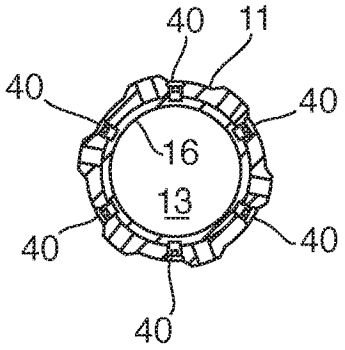
Fig. 3 A-A
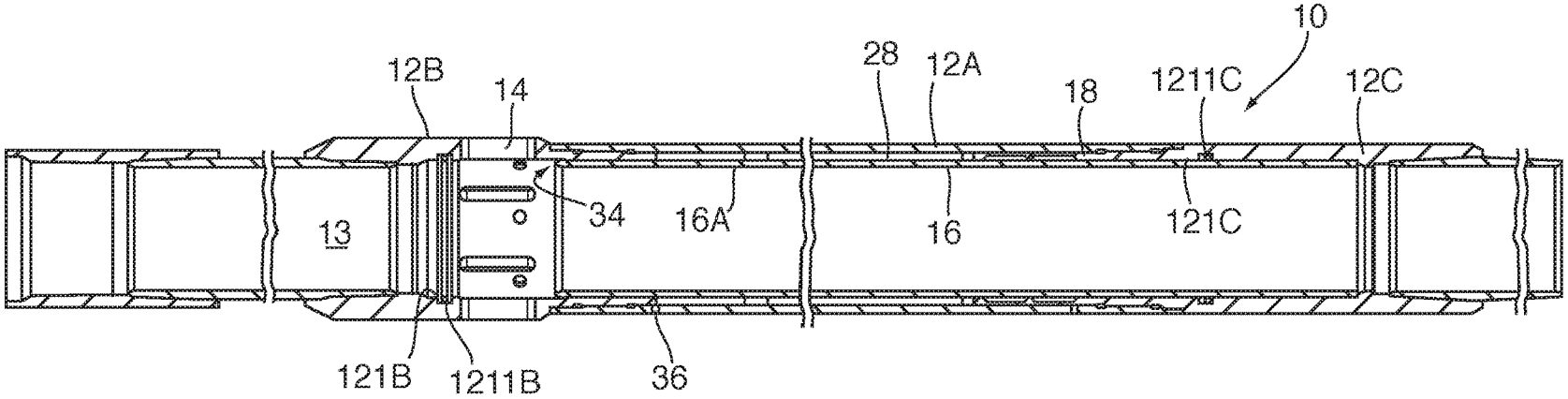
Fig. 4

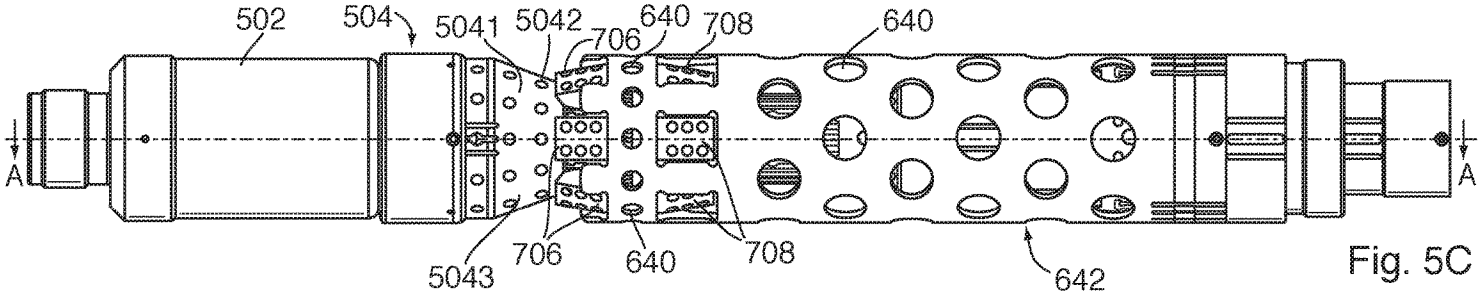
Fig. 5C
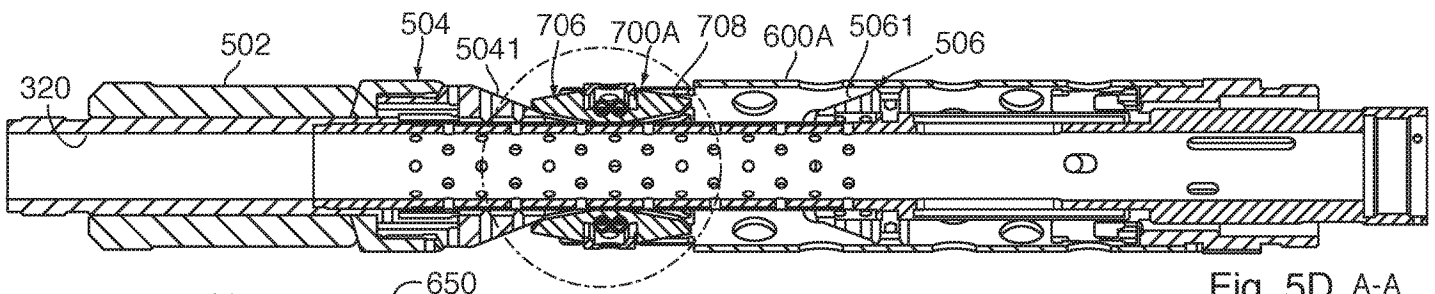
Fig. 5D A-A
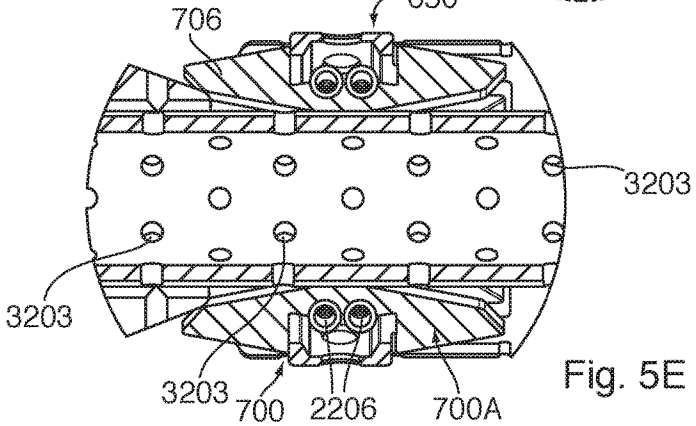
Fig. 5E

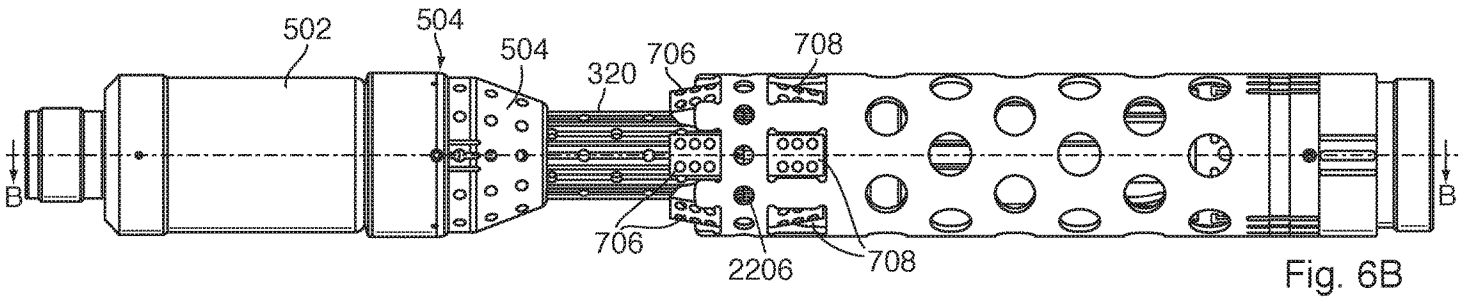
Fig. 6B
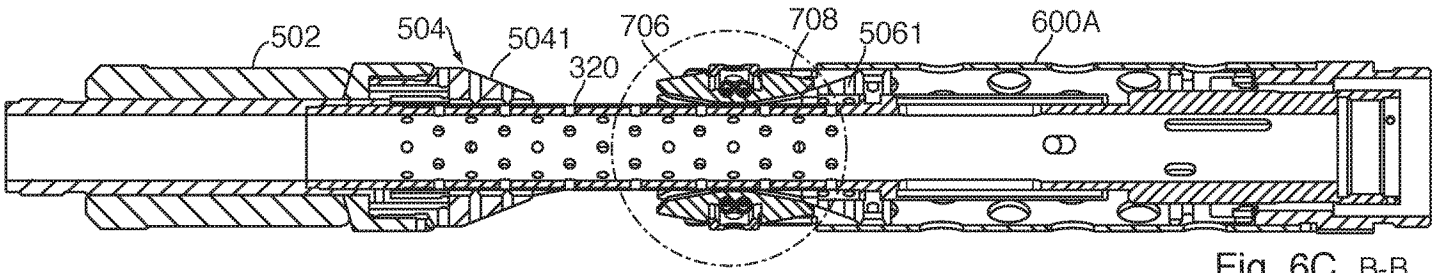
Fig. 6C B-B
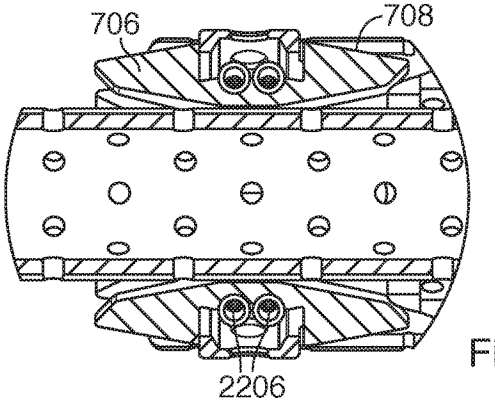
Fig. 6D

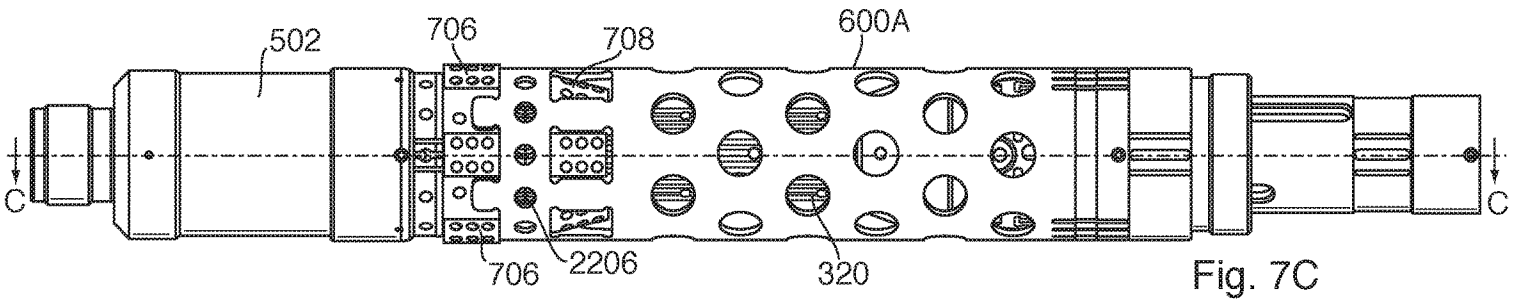
Fig. 7C
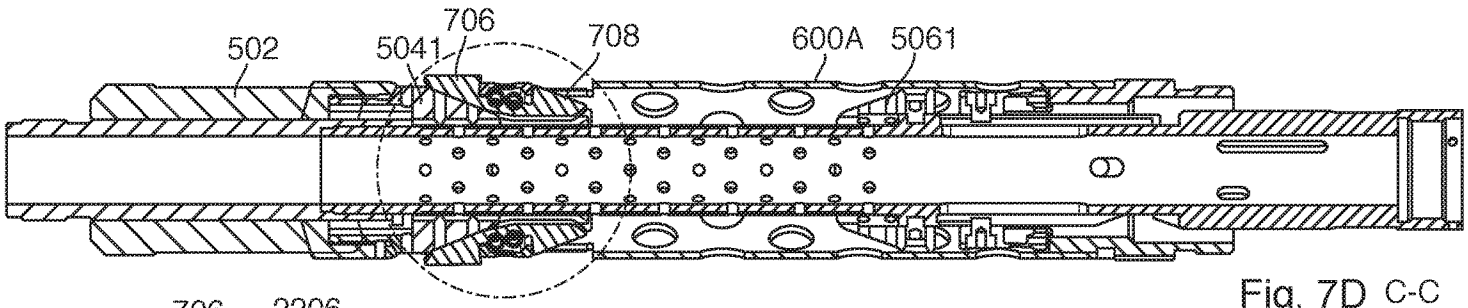
Fig. 7D C-C
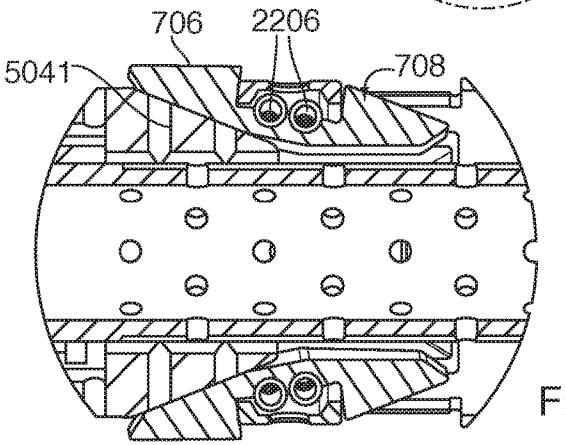
Fig. 7E

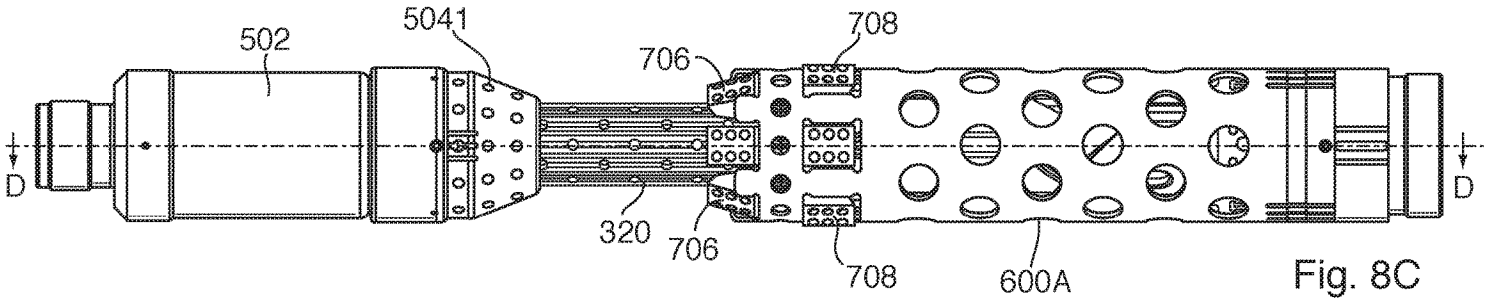
Fig. 8C
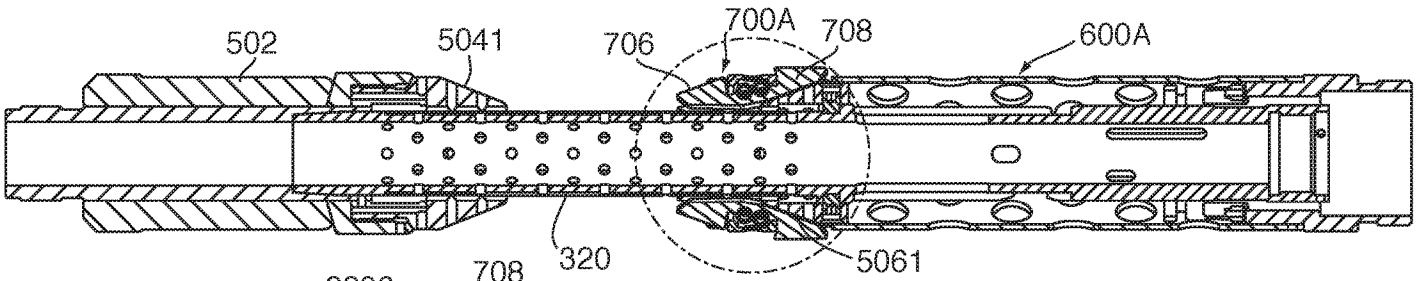
Fig. 8D D-D
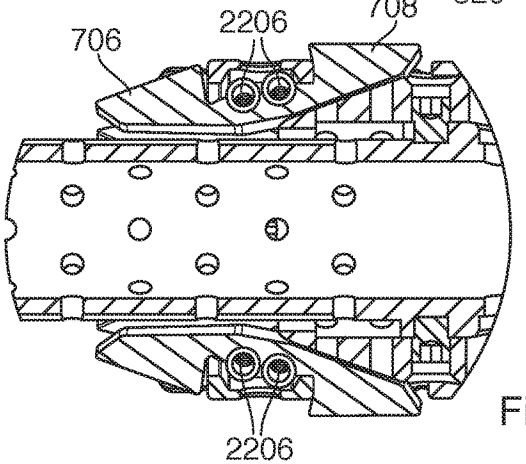
Fig. 8E

TOOL FOR OPENING AND CLOSING SLEEVES WITHIN A WELLBORE

CROSS-REFERENCE TO RELATED APPLICATIONS

This claims priority from U.S. Provisional Patent Application No. 62/097,245, filed Dec. 29, 2014, the entire contents of which are incorporated herein by reference.

FIELD

This disclosure relates to treatment material of a hydrocarbon-containing reservoir.

BACKGROUND

Closeable sleeves are useful to provide operational flexibility during fluid treatment of a hydrocarbon-containing reservoir. Existing forms of such closeable sleeve are overly complicated and include unnecessary components, and are prone to unnecessary mechanical stresses. Also, problems exist with closing these sleeves immediately after fluid treatment, owing to the existence of solid materials in the vicinity of the treatment material port.

SUMMARY

In one aspect, there is provided a bottomhole assembly for deployment within a wellbore string disposed within a wellbore, the wellbore string including a port and a flow control member, wherein the flow control member is displaceable relative to the port for effecting opening and closing of the port, comprising: a first mandrel; a second mandrel configured for becoming disposed within a locate profile of the wellbore string such that resistance to displacement of the second mandrel, relative to the locate profile, is effected, and such that locating of the second mandrel within the wellbore string is thereby effected; a shifting tool including a first gripper surface and a second gripper surface; a first shifting tool actuator, translatable with the first mandrel; and a second shifting tool actuator, translatable with the first mandrel; wherein the shifting tool is co-operatively disposed relative to the second mandrel such that: the shifting tool is displaceable in response to urging by the first shifting tool actuator that is effected by downhole displacement of the first mandrel relative to the second mandrel such that the first gripper surface is displaced outwardly to a first gripper surface gripping position for becoming disposed in gripping engagement with the flow control member; and the shifting tool is displaceable in response to urging by the second shifting tool actuator that is effected by uphole displacement of the first mandrel relative to the second mandrel, such that the second gripper surface is displaced outwardly to a second gripper surface gripping position for becoming disposed in gripping engagement with the flow control member.

In another aspect, there is provided a bottomhole assembly for deployment within a wellbore string disposed within a wellbore, the wellbore string including a port and a flow control member, wherein the flow control member is displaceable relative to the port for effecting opening and closing of the port, comprising: a first mandrel; a second mandrel including a locator for becoming disposed within a locate profile of the wellbore string such that resistance to displacement of the second mandrel, relative to the locate profile, is effected, and such that locating of the bottomhole assembly within the wellbore string is thereby effected; a shifting tool including a first gripper surface and a second gripper surface; a first shifting tool actuator, translatable with the first mandrel; and a second shifting tool actuator, translatable with the first mandrel; wherein: the shifting tool is displaceable in response to urging by the first shifting tool actuator that is effected by downhole displacement of the first mandrel relative to the second mandrel, such that the first gripper surface is displaced outwardly to a first gripper surface gripping position for becoming disposed in gripping engagement with the flow control member; the shifting tool is displaceable in response to urging by the second shifting tool actuator that is effected by uphole displacement of the first mandrel relative to the second mandrel, such that the second gripper surface is displaced outwardly to a second gripper surface gripping position for becoming disposed in gripping engagement with the flow control member; and the second mandrel includes a retainer for limiting displacement of the shifting tool in both of downhole and uphole directions.

In another aspect, there is provided a bottomhole assembly for deployment within a wellbore string disposed within a wellbore, the wellbore string including a port and a flow control member, wherein the flow control member is displaceable relative to the port for effecting opening and closing of the port, comprising: a shifting tool including a first gripper surface and a second gripper surface; a first mandrel; a first shifting tool actuator, translatable with the first mandrel; and a second shifting tool actuator, translatable with the first mandrel; wherein: the shifting tool is displaceable in response to urging by the first shifting tool actuator that is effected by downhole displacement of the first mandrel such that the first gripper surface is displaced outwardly to a first gripper surface gripping position for becoming disposed in gripping engagement with the flow control member; and the shifting tool is displaceable in response to urging by the second shifting tool actuator that is effected by uphole displacement of the second mandrel such that the second gripper surface is displaced outwardly to a second gripper surface gripping position for becoming disposed in gripping engagement with the flow control member.

In another aspect, there is provided a method of treating a subterranean formation comprising: deploying a bottomhole assembly within a wellbore string dispose within the wellbore, the wellbore string including a port and a flow control member, wherein the flow control member is displaceable relative to the port for effecting opening and closing of the port, including: a first mandrel, a shifting tool including a first gripper surface and a second gripper surface; a first shifting tool actuator, translatable with the first mandrel; and a second shifting tool actuator, translatable with the first mandrel; wherein: the shifting tool is actuatable in response to urging by the first shifting tool actuator that is effected by downhole displacement of the first mandrel such that the first gripper surface becomes disposed in gripping engagement with the flow control member; and the shifting tool is actuatable in response to urging by the second shifting tool actuator that is effected by uphole displacement of the first mandrel such that the second gripper surface becomes disposed in gripping engagement with the flow control member; actuating the shifting tool such that the first gripper surface becomes disposed in gripping engagement with the flow control member; displacing the flow control member in a downhole direction relative to the port with the first gripper surface while the first gripper surface is disposed in gripping engagement with the flow control member, such that the port becomes opened; supplying treatment material into the subterranean formation via the opened port; after the supplying of the treatment material, actuating the shifting tool such that the second gripper surface becomes disposed in gripping engagement with the flow control member; displacing the flow control member relative to the port in an uphole direction with the second gripper surface while the second gripper surface is disposed in gripping engagement with the flow control member, such that the port becomes closed; and after the closing of the port, shearing the second shifting tool actuator from the first mandrel.

BRIEF DESCRIPTION OF DRAWINGS

The preferred embodiments will now be described with the following accompanying drawings, in which:

FIG. 3 is a sectional view taken along lines A-A in FIG. 1;

FIG. 4 is a side sectional view of the flow control apparatus, incorporated within a wellbore string, as illustrated in FIG. 1, with the flow control member disposed in the open position;

FIGS. 5C, 5D, and 5E illustration a portion of the bottomhole assembly illustrated in FIGS. 5A and 5B, in the run-in-hole mode, FIG. 5C being a side view, FIG. 5D being a sectional side view taken along lines A-A in FIG. 5C, and FIG. 5E being a detailed view of Detail "E" in FIG. 5D;

FIGS. 6B, 6C, and 6D illustration a portion of the bottomhole assembly illustrated in FIG. 6A, in the pull-out of-hole mode, FIG. 6B being a side view, FIG. 6C being a sectional side view taken along lines B-B in FIG. 6B, and FIG. 6D being a detailed view of Detail "F" in FIG. 6C;

FIGS. 7C, 7D, and 7E illustrate a portion of the bottomhole assembly illustrated in FIGS. 7A and 7B, in the set down mode, FIG. 7C being a side view, FIG. 7D being a sectional side view taken along lines C-C in FIG. 7C, and FIG. 7E being a detailed view of Detail "G" in FIG. 7D;

FIGS. 8C, 8D, and 8E illustrate a portion of the bottomhole assembly illustrated in FIGS. 8A and 8B, in the set up mode, FIG. 8C being a side view, FIG. 8D being a sectional side view taken along lines D-D in FIG. 8C, and FIG. 8E being a detailed view of Detail "H" in FIG. 8D;

DETAILED DESCRIPTION

Figure 1:
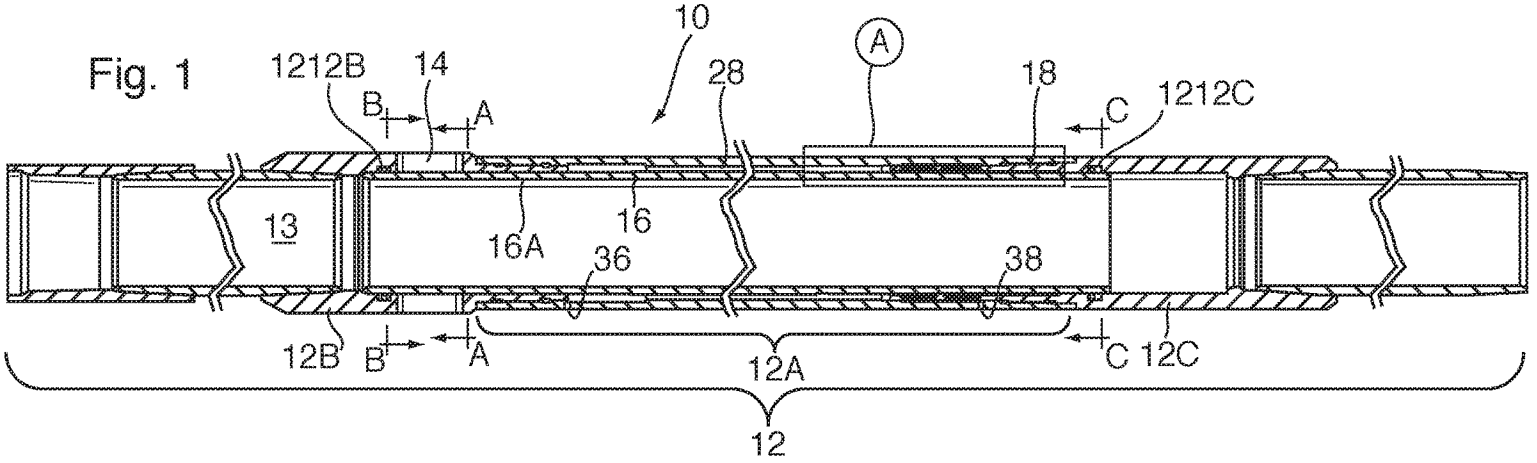
FIG. 1 is a side sectional view of an embodiment of a flow control apparatus of the present disclosure, incorporated within a wellbore string, with the valve closure member disposed in the closed position.

As used herein, the terms "up", "upward", "upper", or "uphole", mean, relativistically, in closer proximity to the surface and further away from the bottom of the wellbore, when measured along the longitudinal axis of the wellbore. The terms "down", "downward", "lower", or "downhole" mean, relativistically, further away from the surface and in closer proximity to the bottom of the wellbore, when measured along the longitudinal axis of the wellbore.

Referring to FIGS. 5 to 12, there is provided a downhole tool system including a flow control apparatus 10 and a bottomhole assembly 100. The downhole tool system is configured for effecting selective stimulation of a subterranean formation 102, such as a hydrocarbon-containing reservoir.

The stimulation is effected by supplying treatment material to the subterranean formation.

In some embodiments, for example, the treatment material is a liquid including water. In some embodiments, for example, the liquid includes water and chemical additives. In other embodiments, for example, the treatment material is a slurry including water, proppant, and chemical additives. Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

The flow control apparatus 10 is configured to be integrated within a wellbore string 11 that is deployable within the wellbore 104. Suitable wellbores 102 include vertical, horizontal, deviated or multi-lateral wells. Integration may be effected, for example, by way of threading or welding.

The wellbore string 11 may include pipe, casing, or liner, and may also include various forms of tubular segments, such as the flow control apparatuses 100 described herein. The wellbore string 11 defines a wellbore string passage 2

Successive flow control apparatuses 10 may be spaced from each other within the wellbore string 11 such that each flow control apparatus 10 is positioned adjacent a producing interval to be stimulated by fluid treatment effected by treatment material that may be supplied through a port 14 (see below).

Referring to FIG. 1, in some embodiments, for example, the flow control apparatus 10 includes a housing 8. A passage 13 is defined within the housing 8. The passage 13 is configured for conducting treatment material, that is received from a supply source (such as a supply source disposed at the surface), to a flow control apparatus port 14 that is also defined within and extends through the housing 8. As well, in some embodiments, for example, the passage 13 is configured to receive a bottomhole assembly 100 (see below) to actuate a flow control member 16 of the flow control apparatus 10 (see below). In some embodiments, for example, the flow control apparatus 10 is a valve apparatus, and the flow control member 16 is a valve closure member.

In some embodiments, for example, the housing 8 includes an intermediate housing section 12A (such as a "barrel"), an upper crossover sub 12B, and a lower crossover sub 12C. The intermediate housing section 12A is disposed between the upper and lower crossover subs 12B, 12C. In some embodiments, for example, the intermediate housing section 12A is disposed between the upper and lower crossover subs 12B, 12C, and is joined to both of the upper and lower crossover subs with threaded connections. Axial and torsional forces may be translated from the upper crossover sub 12B to the lower crossover sub 12C via the intermediate housing section 12A.

The housing 8 is coupled (such as, for example, threaded) to other segments of the wellbore string 11, such that the wellbore string passage 2 includes the housing passage 13. In some embodiments, for example, the wellbore string 11 is lining the wellbore 104. The wellbore string 11 is provided for, amongst other things, supporting the subterranean formation within which the wellbore is disposed. As well, in some embodiments, for example, the wellbore string passage 2 of the wellbore string 11 functions for conducting treatment material from a supply source. The wellbore string 11 may include multiple segments, and the segments may be connected (such as by a threaded connection).

In some embodiments, for example, it is desirable to inject treatment material into a predetermined zone (or "interval") of the subterranean formation 102 via the wellbore 104. In this respect, the treatment material is supplied into the wellbore 104, and the flow of the supplied treatment material is controlled such that a sufficient fraction of the supplied treatment material (in some embodiments, all, or substantially all, of the supplied treatment material) is directed, via a flow control apparatus port 14 of the flow control apparatus 10, to the predetermined zone. In some embodiments, for example, the flow control apparatus port 14 extends through the housing 8. During treatment, the flow control apparatus port 14 effects fluid communication between the passage 13 and the subterranean formation 102. In this respect, during treatment, treatment material being conducted from the treatment material source via the passage 13 is supplied to the subterranean formation 102 via the flow control apparatus port 14.

As a corollary, the flow of the supplied treatment material is controlled such that injection of the injected treatment material to another zone of the subterranean formation is prevented, substantially prevented, or at least interfered with. The controlling of the flow of the supplied treatment material, within the wellbore 104, is effected, at least in part, by the flow control apparatus 10.

In some embodiments, for example, conduction of the supplied treatment to other than the predetermined zone may be effected, notwithstanding the flow control apparatus 10, through an annulus 112, that is disposed within the wellbore 104, between the wellbore string 11 and the subterranean formation 102. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port 14 and the remote zone, is prevented, or substantially prevented, or at least interfered with, by a zonal isolation material 105. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the flow control apparatus port 14, or of any cement that has become disposed within the port 14, prior to cementing, the port 14 may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2TM grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the flow control apparatus 10 includes the flow control member 16, and the flow control member 16 is displaceable, relative to the flow control apparatus port 14, for effecting opening and closing of the flow control apparatus port 14. In this respect, the flow control member 16 is displaceable such that the flow control member 16 is positionable in open (see FIG. 4) and closed (see FIG. 1) positions. The open position of the flow control member 16 corresponds to an open condition of the flow control apparatus port 14. The closed position of the flow control member 16 corresponds to a closed condition of the flow control apparatus port 14.

In some embodiments, for example, in the closed position, the flow control apparatus port 14 is covered by the flow control member 16, and the displacement of the flow control member 16 to the open position effects at least a partial uncovering of the flow control apparatus port 14 such that the flow control apparatus port 14 becomes disposed in the open condition. In some embodiments, for example, in the closed position, the flow control member 16 is disposed, relative to the flow control apparatus port 14, such that a sealed interface is disposed between the passage 13 and the subterranean formation 102, and the disposition of the sealed interface is such that treatment material being supplied through the passage 13 is prevented, or substantially prevented, from being injected, via the flow control apparatus port 14, into the subterranean formation 102, and displacement of the flow control member 16 to the open position effects fluid communication, via the flow control apparatus port 14, between the passage 13 and the subterranean formation 102, such that treatment material being supplied through the passage 13 is injected into the subterranean formation 102 through the flow control apparatus port 14. In some embodiments, for example, the sealed interface is established by sealing engagement between the flow control member 16 and the housing 8. In some embodiments, for example, "substantially preventing fluid flow through the flow control apparatus port 14" means, with respect to the flow control apparatus port 14, that less than 10 volume %, if any, of fluid treatment (based on the total volume of the fluid treatment) being conducted through the passage 13 is being conducted through the flow control apparatus port 14.

In some embodiments, for example, the flow control member 16 includes a sleeve. The sleeve is slideably disposed within the passage 13.

In some embodiments, for example, the flow control member 16 is displaced from the closed position (see FIG. 1) to the open position (see FIG. 4) and thereby effect opening of the flow control apparatus port 14. Such displacement is effected while the flow control apparatus 10 is deployed downhole within a wellbore 104 (such as, for example, as part of a wellbore string 11), and such displacement, and consequential opening of the flow control apparatus port 14, enables treatment material, that is being supplied from the surface and through the wellbore 104 via the wellbore string 11, to be injected into the subterranean formation 102 via the flow control apparatus port 14. In some embodiments, for example, by enabling displacement of the flow control member 16 between the open and closed positions, pressure management during hydraulic fracturing is made possible.

In some embodiments, for example, the flow control member 16 is displaced from the open position to the closed position and thereby effect closing of the port 16. Displacing the flow control member 16 from the open position to the closed position may be effected after completion of the supplying of treatment material to the subterranean formation 102 through the flow control apparatus port 14. In some embodiments, for example, this enables the delaying of production through the flow control apparatus port 14, facilitates controlling of wellbore pressure, and also mitigates ingress of sand from the formation 102 into the casing, while other zones of the subterranean formation 102 are now supplied with the treatment material through other ports 14. In this respect, after sufficient time has elapsed after the supplying of the treatment material to a zone of the subterranean formation 102, such that meaningful fluid communication has become established between the hydrocarbons within the zone of the subterranean formation 102 and the flow control apparatus port 14, by virtue of the interaction between the subterranean formation 102 and the treatment material that has been previously supplied into the subterranean formation 102 through the flow control apparatus port 14, and, optionally, after other zones of the subterranean formation 102 have similarly become disposed in fluid communication with other ports 14, the flow control member(s) may be displaced to the open position so as to enable production through the wellbore. Displacing the flow control member 16 from the open position to the closed position may also be effected while fluids are being produced from the formation 102 through the flow control apparatus port 14, and in response to sensing of a sufficiently high rate of water production from the formation 102 through the flow control apparatus port 14. In such case, displacing the flow control member 16 to the closed position blocks, or at least interferes with, further production through the associated flow control apparatus port 14.

The flow control member 16 is configured for displacement, relative to the flow control apparatus port 14, in response to application of a sufficient force. In some embodiments, for example, the application of a sufficient force is effected by a sufficient fluid pressure differential that is established across the flow control member 16. In some embodiment embodiments, for example, for example, the sufficient force is established by a force, applied to a bottomhole assembly 100, and then translated, via the bottomhole assembly 100, to the flow control member 16 (see below). In some embodiments, for example, the sufficient force, applied to effect opening of the flow control apparatus port 14 is a flow control member opening force, and the sufficient force, applied to effect closing of the port is a flow control member closing force.

In some embodiments, for example, the housing 8 includes an inlet 9. While the apparatus 100 is integrated within the wellbore string 11, and while the wellbore string 11 is disposed downhole within a wellbore 104 such that the inlet 9 is disposed in fluid communication with the surface via the wellbore string 11, and while the flow control apparatus port 14 is disposed in the open condition, fluid communication is effected between the inlet 9 and the subterranean formation 102 via the passage 13, and via the flow control apparatus port 14, such that the subterranean formation 102 is also disposed in fluid communication, via the flow control apparatus port 14, with the surface (such as, for example, a source of treatment fluid) via the wellbore string 11. Conversely, while the flow control apparatus port 14 is disposed in the closed condition, at least increased interference, relative to that while the port 14 is disposed in the open condition, to fluid communication (and, in some embodiments, sealing, or substantial sealing, of fluid communication), between the inlet 9 and the subterranean formation 102, is effected such that the sealing, or substantial sealing, of fluid communication, between the subterranean formation 102 and the surface, via the flow control apparatus port 14, is also effected.

Referring to FIGS. 1 and 4, in some embodiments, for example, the housing 8 includes one or more sealing surfaces configured for sealing engagement with a flow control member 16, wherein the sealing engagement defines the sealed interface described above. In this respect, the internal surface 121B, 121C of each one of the upper and lower crossover subs, independently, includes a respective one of the sealing surfaces 1211B, 1211C, and the sealing surfaces 1211B, 1211C are configured for sealing engagement with the flow control member 16. In some embodiments, for example, for each one of the upper and lower crossover subs 12B, 12C, independently, the sealing surface 1211B, 1211C is defined by a respective sealing member 1212B, 1212C. In some embodiments, for example, when the flow control member 16 is in the closed position, each one of the sealing members 1212B, 1212C, is, independently, disposed in sealing engagement with both of the valve housing 8 (for example, the sealing member 1212B is sealingly engaged to the upper crossover sub 12B and housed within a recess formed within the sub 12B, and the sealing member 1212C is sealingly engaged to the lower crossover sub 12C and housed within a recess formed within the sub 12C) and the flow control member 16. In some embodiments, for example, each one of the sealing members 1212B, 1212C, independently, includes an o-ring. In some embodiments, for example, the o-ring is housed within a recess formed within the respective crossover sub. In some embodiments, for example, the sealing member 1212B, 1212C includes a molded sealing member (i.e. a sealing member that is fitted within, and/or bonded to, a groove formed within the sub that receives the sealing member).

In some embodiments, for example, the flow control apparatus port 14 extends through the housing 8, and is disposed between the sealing surfaces 1211B, 1211C.

In some embodiments, for example, the flow control member 16 co-operates with the sealing members 1212B, 1212C to effect opening and closing of the flow control apparatus port 14. When the flow control apparatus port 14 is disposed in the closed condition, the flow control member 16 is sealingly engaged to both of the sealing members 1212B, 1212C, and thereby preventing, or substantially preventing, treatment material, being supplied through the passage 13, from being injected into the subterranean formation 102 via the flow control apparatus port 14. When the flow control apparatus port 14 is disposed in the open condition, the flow control member 16 is spaced apart or retracted from at least one of the sealing members (such as the sealing member 1212B), thereby providing a passage for treatment material, being supplied through the passage 13, to be injected into the subterranean formation 102 via the flow control apparatus port 14.

Figure 4A:
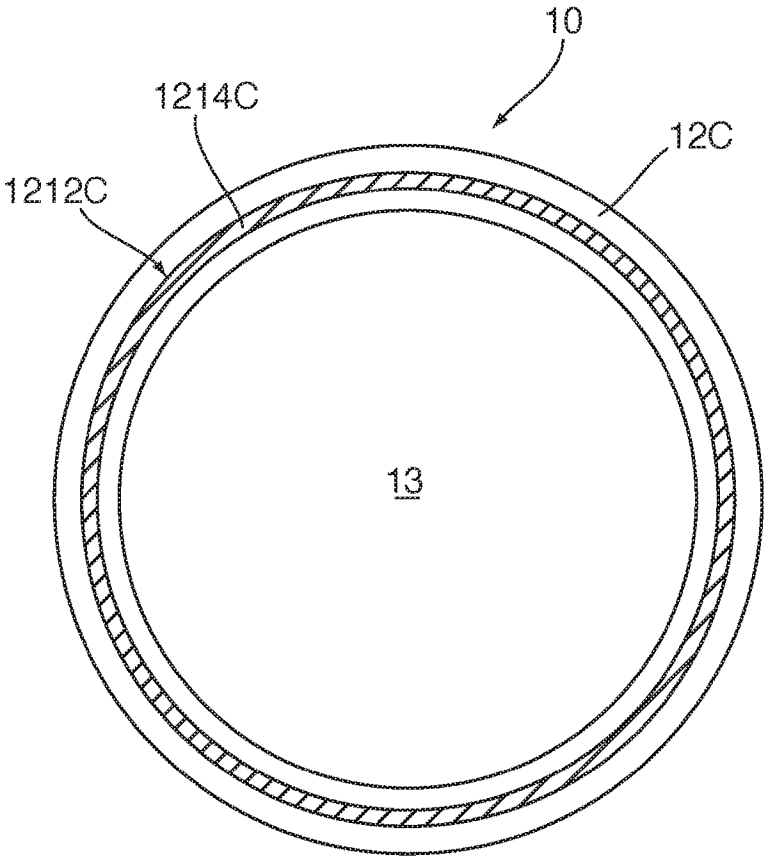
FIG. 4A is a sectional view taken along lines B-B in FIG. 1.
Figure 4B:
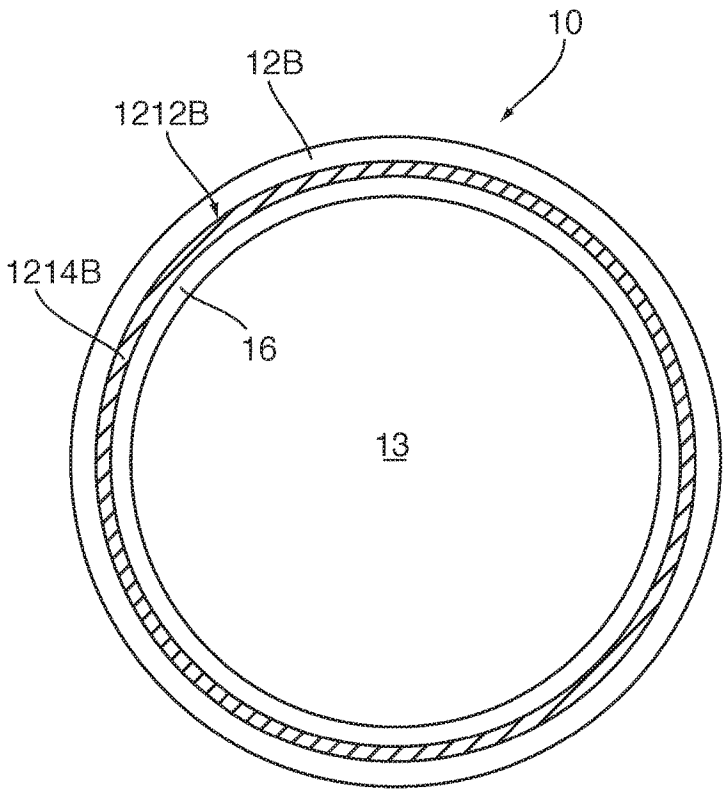
FIG. 4B is a sectional view taken along lines C-C in FIG. 1.
Figure 5A:
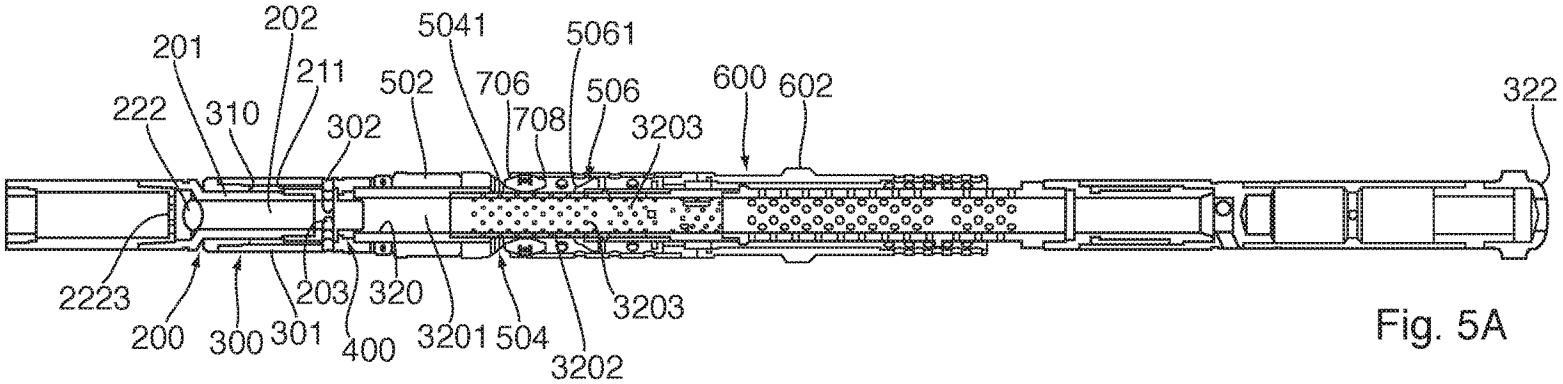
FIGS. 5A and 5B illustrate an embodiment of a bottomhole assembly of the present disclosure, incorporating the flow control apparatus of FIG. 1, in the run-in-hole mode, FIG. 5A being a side view, and FIG. 5B being a side sectional view.
Figure 5B:
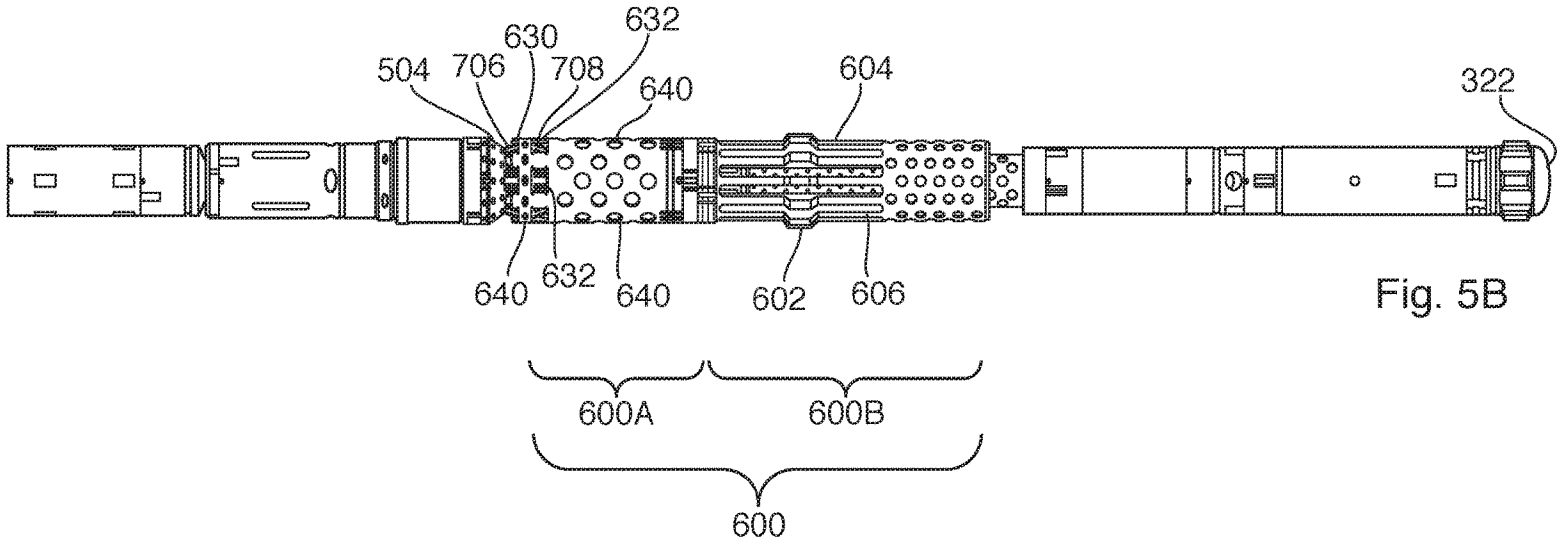
Figure 6A:
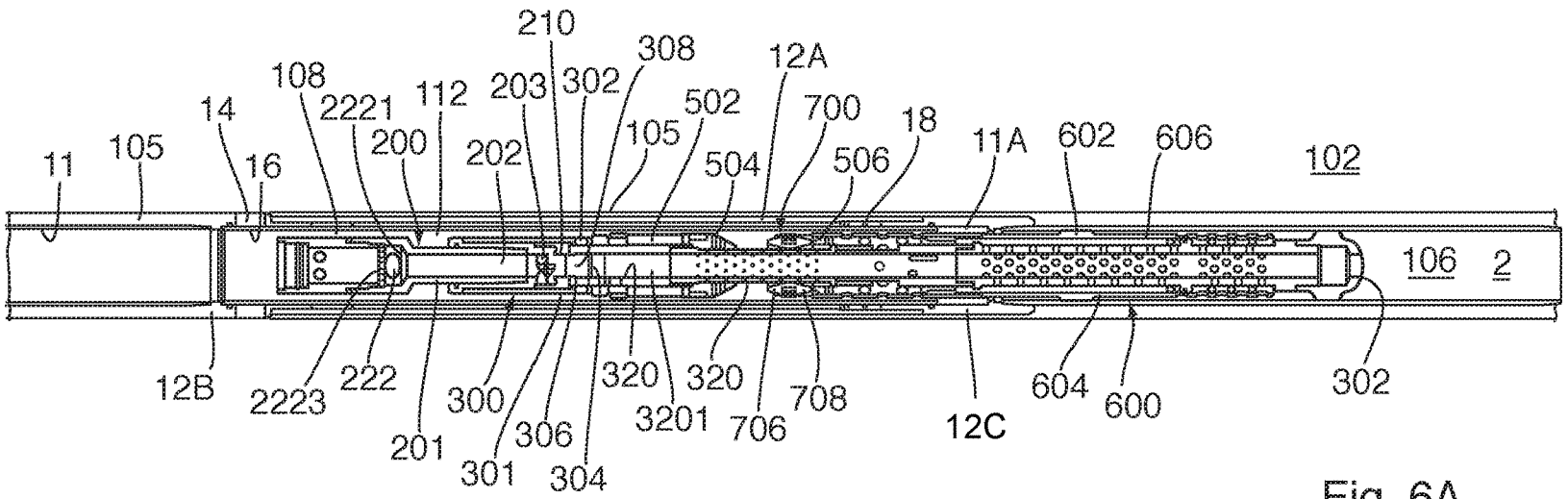
FIG. 6A is a side sectional view of an embodiment of a bottomhole assembly of the present disclosure, incorporating the flow control apparatus of FIG. 1 and disposed within a wellbore, in the pull-out-of-hole mode.

Referring to FIGS. 4A and 4B, in some embodiments, for example, each one of the sealing members 1212B, 1212C, independently, defines a respective fluid pressure responsive surface 1214B, 1214C, with effect that while the flow control member 16 is disposed in the closed position, and in sealing engagement with the sealing members 1212B, 1212C, each one of the fluid pressure responsive surfaces 1214B, 1214C, independently, is configured to receive application of fluid pressure from fluid disposed within the passage 13. In some embodiments, for example, each one of the surfaces 1214B, 1214C, independently, extends between the valve housing 8 (for example, the surface 1214B extends from the upper crossover sub 12B, such as a groove formed or provided in the upper crossover sub 12B, and the surface 1214C extends from the lower crossover sub 12C, such as a groove formed or provided in the lower crossover sub 12C) and the flow control member 16. In one aspect, the total surface area of one of the surfaces 1214B, 1214C is at least 90% of the total surface area of the other one of the surfaces 1214B, 1214C. In some embodiments, for example, the total surface area of one of the surfaces 1214B, 1414C is at least 95% of the total surface area of the other one of the surfaces 1214B, 1214C. In some embodiments, for example, the total surface area of the surface 1214B is the same, or substantially the same, as the total surface area of the surface 1214C. By co-operatively configuring the surfaces 1214B, 1214C in this manner, inadvertent opening of the flow control member 16, by unbalanced fluid pressure forces, is mitigated.

Referring to FIGS. 1, 2, 2A, 2B, 2C, and 4, a resilient retainer member 18 extends from the housing 12, and is configured to releasably engage the flow control member 16 for resisting a displacement of the flow control member 16. In this respect, in some embodiments, for example, the resilient retainer member 18 includes at least one finger 18A, and each one of the at least one finger includes a tab 18B that engages the flow control member 16. In some embodiments, for example, the engagement of the tab 18B to the flow control member 16 is effected by disposition of the tab 18B within a recess of the flow control member 16.

In some embodiments, for example, the flow control apparatus 10 includes a collet 19 that extends from the housing 12, and the collet 19 includes the resilient retainer member 18.

In some embodiments, for example, the flow control member 16 and the resilient retainer member 18 are co-operatively configured such that engagement of the flow control member 16 and the resilient retainer member 18 is effected while the flow control member 16 is disposed in the open position and also when the flow control member 16 is disposed in the closed position. In this respect, while the flow control member 16 is disposed in the closed position, the resilient retainer member 18 is engaging the flow control member 16 such that resistance is being effected to displacement of the flow control member 16 from the closed position to the open position. In some embodiments, for example, the engagement is such that the resilient retainer member 18 is retaining the flow control member 16 in the closed position. Also in this respect, while the flow control member 16 is disposed in the open position, the resilient retainer member 18 is engaging the flow control member 16 such that resistance is being effected to displacement of the flow control member 16 from the open position to the closed position. In some embodiments, for example, the engagement is such that the resilient retainer member 18 is retaining the flow control member 16 in the open position.

Figure 2:
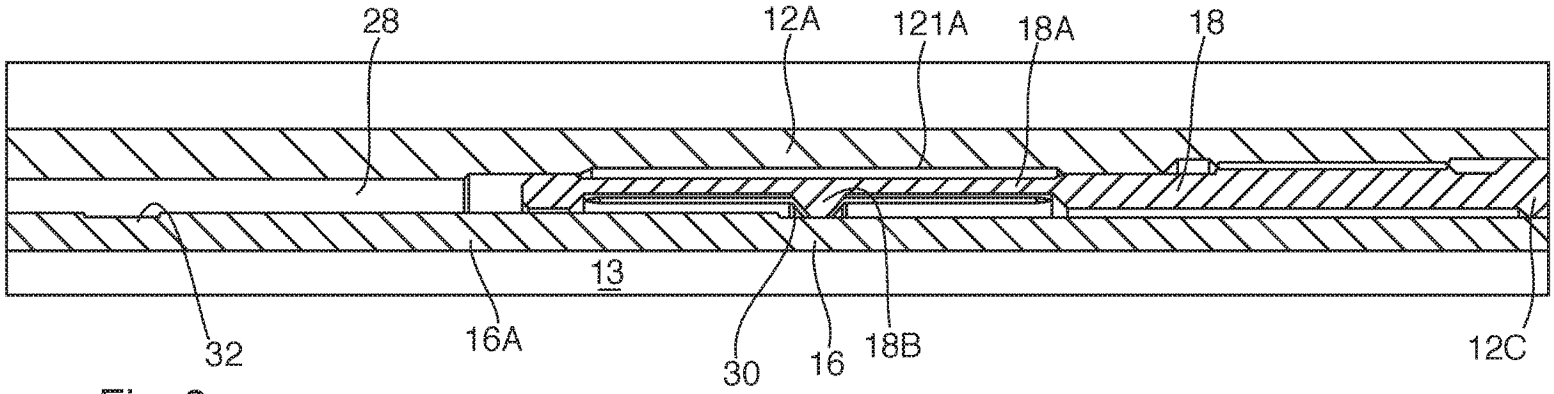
FIG. 2 is an enlarged view of Detail "A" of FIG. 1.
Figure 2A:
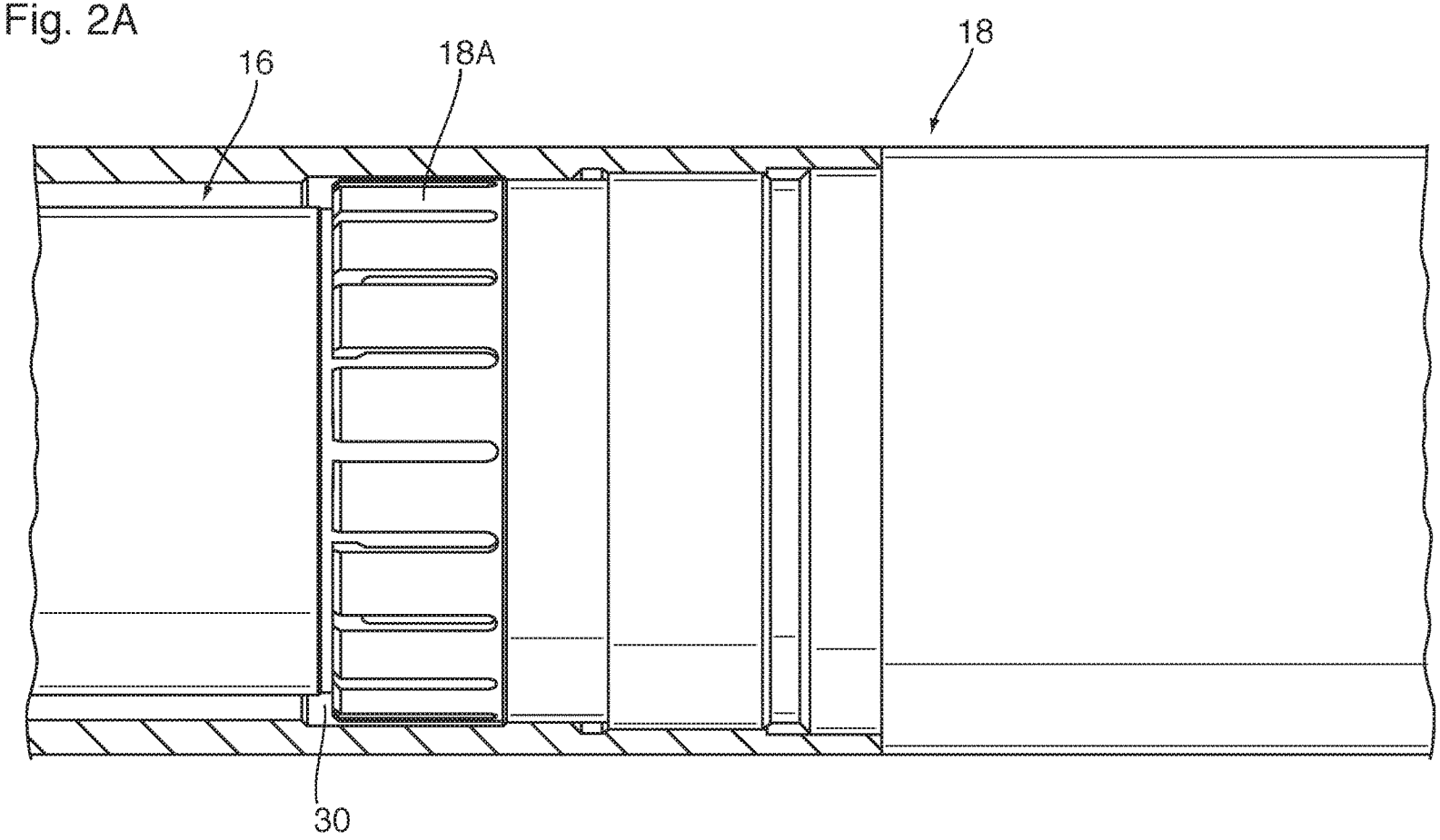
FIG. 2A is a detailed elevation view of a portion of the flow control apparatus of FIG. 1, illustrating the collet disposed in engagement with the closed position-defining recess of the valve closure member.
Figure 2B:
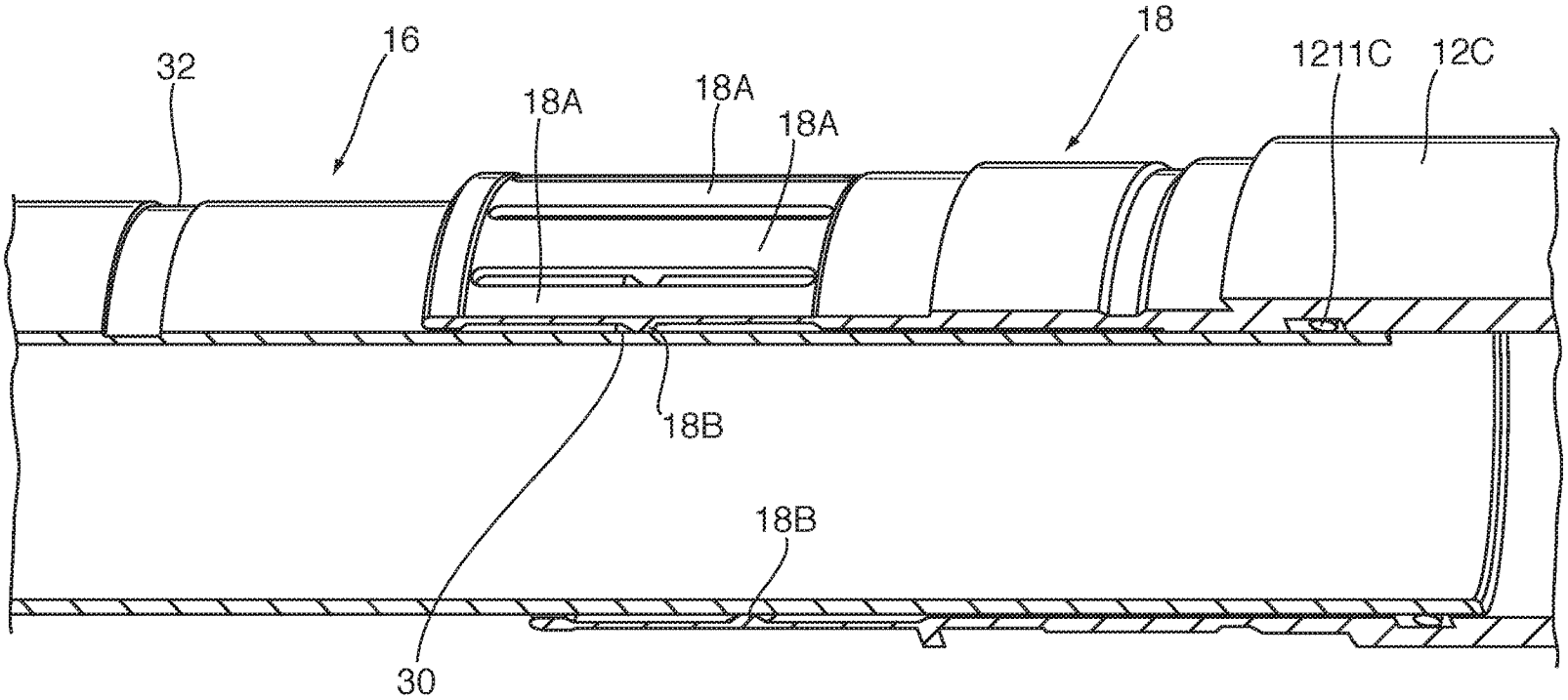
FIG. 2B is a detailed fragmentary perspective view of a portion of the flow control apparatus of FIG. 1, illustrating the collet disposed in engagement with the closed position-defining recess of the valve closure member.
Figure 2C:
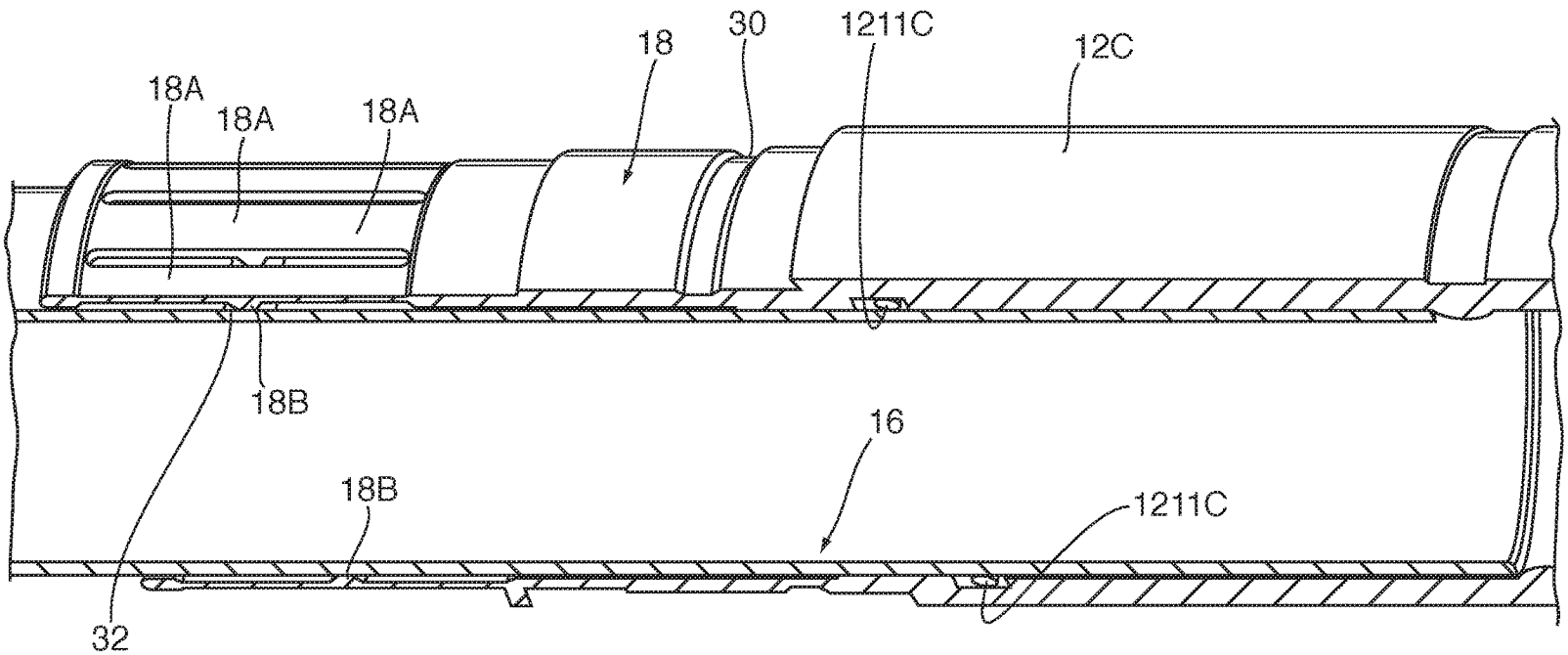
FIG. 2C is a detailed fragmentary perspective view of a portion of the flow control apparatus of FIG. 1, illustrating the collet disposed in engagement with the open position-defining recess of the valve closure member.

Referring to FIGS. 2 and 2A, in some embodiments, for example, the flow control member 16 includes a closed position-defining recess 30 and an open position-defining recess 32. The at least one finger 18A and the recesses 30, 32 are co-operatively configured such that while the flow control member 16 is disposed in the closed position, the finger tab 18B is disposed within the closed position-defining recess 30 (see FIG. 2B), and, while the flow control member 16 is disposed in the open position, the finger tab 18B is disposed within the open position-defining recess 32 (see FIG. 2C).

In some embodiments, for example, the resilient retainer member 18 is resilient such that the resilient retainer member 18 is displaceable from the engagement with the flow control member 16 in response to application of the opening force to the flow control member 16. In some embodiments, for example, such displacement includes deflection of the resilient retainer member 18. In some embodiments, for example, the deflection includes a deflection of a finger tab 18B that is disposed within a recess of the flow control member 16, and the deflection of the finger tab 18B is such that the finger tab 18B becomes disposed outside of the recess of the flow control member 16. When the flow control member 16 is disposed in the open position, such displacement removes the resistance being effected to displacement of the flow control member 16 from the open position to the closed position (and thereby permit the flow control member 16 to be displaced from the open position to the closed position, in response to application of an opening force). When the flow control member 16 is disposed in the closed position, such displacement removes the resistance being effected to displacement of the flow control member 16 from the closed position to the open position (and thereby permit the flow control member 16 to be displaced from the closed position to the open position, in response to application of a closing force).

In some embodiments, for example. in order to effect the displacement of the flow control member 16 from the closed position to the open position, the opening force is sufficient to effect displacement of the tab 18B from (or out of) the closed position-defining recess 30. In this respect, the tab 18B is sufficiently resilient such that application of the opening force effects the displacement of the tab 18B from the recess 30, such as by the deflection of the tab 18B. Once the finger tab 18B has become displaced out of the closed position-defining recess 30, continued application of force to the flow control member 16 (such as, in the illustrated embodiment, in a downwardly direction) effects displacement of the flow control member 16 from the closed position to the open position. In order to effect the displacement of the flow control member 16 from the open position to the closed position, the closing force is sufficient to effect displacement of the tab 18B from (or out of) the open position-defining recess 32, such as by deflection of the tab 18B. In this respect, the tab 18B is sufficiently resilient such that application of the closing force effects the displacement of the tab 18B from the recess 32. Once the tab 18*b* has become displaced out of the open position-defining recess 32, continued application of force to the flow control member 16 (such as, in the illustrated embodiment, in an upwardly direction) effects displacement of the flow control member 16 from the open position to the closed position.

Each one of the opening force and the closing force may be, independently, applied to the flow control member 16 mechanically, hydraulically, or a combination thereof. In some embodiments, for example, the applied force is a mechanical force, and such force is applied by a shifting tool. In some embodiments, for example, the applied force is hydraulic, and is applied by a pressurized fluid.

Referring to FIG. 3, in some embodiments, for example, while the apparatus 10 is being deployed downhole, the flow control member 16 is maintained disposed in the closed position by one or more shear pins 40. The one or more shear pins 40 are provided to secure the flow control member 16 to the wellbore string 11 (including while the wellbore string is being installed downhole) so that the passage 13 is maintained fluidically isolated from the formation 102 until it is desired to treat the formation 102 with treatment material. To effect the initial displacement of the flow control member 16 from the closed position to the open position, sufficient force must be applied to the one or more shear pins 40 such that the one or more shear pins become sheared, resulting in the flow control member 16 becoming moveable relative to the flow control apparatus port 14. In some operational implementations, the force that effects the shearing is applied by a workstring (see below).

Referring to FIGS. 1, 2 and 4, the intermediate housing section 12A and the flow control member 16 are co-operatively positioned relative to one another to define a retainer housing space 28 between the intermediate housing section 12A and the flow control member 16. In some of these embodiments, for example, each one of the sealing surfaces 1211B, 1211C (of the upper and lower crossover subs 12B, 12C), independently, is disposed closer to the axis of the passage 13 than an internal surface 121A of the intermediate housing section 121A. In some embodiments, for example, the internal surface 121A of the intermediate housing section 12A is disposed further laterally (e.g. radially) outwardly from the axis of the passage 13, relative to the sealing surfaces 1211B, 1211C, such that the retainer housing space 28 is disposed between the intermediate housing section 12A and the flow control member 16 while the flow control member 16 is disposed in sealing engagement to the sealing surfaces 1211B, 1211C, and thus disposed in the closed position.

The retainer housing space 28 co-operates with the flow control member 16 such that, at least while the flow control member 16 is disposed in the closed position, fluid communication between the retainer housing space 28 and the passage 13 is prevented or substantially prevented. By providing this configuration, the ingress of solid material, such as solid debris or proppant, from the passage 13 and into the retainer housing space 28, which may otherwise interfere with co-operation of the resilient retainer member 18 and the flow control member 16, and may also interfere with displacement of the flow control member 16, is at least mitigated.

In some embodiments, for example, such as in the embodiment illustrated in FIG. 4, while the flow control member 16 is disposed in the open position, at least some fluid communication may become established, within the wellbore string 11, between the passage 13 and the retainer housing space 28, albeit through a fluid passage 34, within the valve housing 8, defined by a space between the upper cross-over sub 12B and the flow control member 16, having a relatively small cross-sectional flow area, and defining a relatively tortuous flowpath. In this respect, in some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the passage 13 and the retainer housing space 28, has a maximum cross-sectional area of less than 0.20 square inches (such as 0.01 square inches). In some embodiments, for example, the upper cross-over sub 12B and the flow control member 16 are closely-spaced relative to one another such that any fluid passage 34 that is defined by a space between the upper cross-over sub 12B and the flow control member 16, and effecting fluid communication between the casing passage 13 and the retainer housing space 28, has a maximum cross-sectional area of less than 0.20 square inches (such as 0.01 square inches). By providing this configuration, the ingress of solid material, such as solid debris or proppant, from the passage 13 and into the retainer housing space 28, which may otherwise interfere with co-operation of the resilient retainer member 18 and the flow control member 16, and may also interfere with movement of the flow control member 16, is at least mitigated.

In some embodiments, for example, an additional sealing member may be disposed (such as, for example, downhole of the flow control apparatus port 14) within the space between the upper cross-over sub 12B and the flow control member 16 (for example, such as being trapped within a groove formed or provided in the upper crossover sub 12B), for sealing fluid communication between passage 13 and the retainer housing space 28, and, when the flow control member 16 is disposed in the open position, for sealing fluid communication between the flow control apparatus port 14 and the retainer housing space 28.

Referring to FIGS. 1 and 4, a vent hole 36 extends through the intermediate housing section 12A, for venting the retainer housing space 28 externally of the intermediate housing section 12A. By providing for fluid communication between the retainer housing space 28 and the formation 102 through the vent hole 36, the creation of a pressure differential between the formation 102 and the retainer housing space 28, and across the intermediate housing section 12A, including while the flow control member 16 is disposed in the closed position, is at least mitigated, and thereby at least mitigating application of stresses (such as hoop stress) to the intermediate housing section 12A. By mitigating stresses being applied to the intermediate housing section 12A, the intermediate housing section does not need to be designed to such robust standards so as to withstand applied stresses, such as those which may be effected if there existed a high pressure differential between the formation 102 and the space between the intermediate housing section and the flow control member 16. In some embodiments, for example, the intermediate housing section 12A may include 5-1/2 American Petroleum Institute ("API") casing, P110, 17 pounds per foot. In some embodiments, for example, the section 12A includes mechanical tubing.

Prior to cementing, the retainer housing space 28 may be filled with encapsulated cement retardant through the grease injection hole 38 (and, optionally, the vent hole 36), so as to at least mitigate ingress of cement during cementing, and also to at least mitigate curing of cement in space that is in proximity to the vent hole 36, or of any cement that has become disposed within the vent hole or the retainer housing space 28. In those embodiments where, while the flow control member 16 is disposed in the open position, fluid communication may become effected, within the wellbore string 11, between the retainer housing space 28 and the passage 13 through a relatively small fluid passage 34 defined between the flow control member 16 and the upper cross-over sub 12B, the encapsulated cement retardant disposed within the retainer housing space 28, in combination with the relatively small flow area provided by the fluid passage 34 established between the upper cross-over sub 12B and the flow control member 16 (while the flow control member 16 is disposed in the open position), at least mitigates the ingress of solids (including debris or proppant) from within the passage 13, and/or from the fluid treatment flow control apparatus port 14, to the retainer housing space 28.

In those embodiments where the wellbore string 11 is cemented to the formation 102, and where each one of the cross-over subs 12B, 12C, independently, includes a sealing member 1211B, 1211C, during cementing, such sealing members may function to prevent ingress of cement into the retainer housing space 28, while the flow control member 16 is disposed in the closed position.

As mentioned above, in some embodiments, both of the opening force and the closing force are imparted by a shifting tool, and the shifting tool is integrated within a downhole tool, such as a bottomhole assembly 100, that includes other functionalities.

Referring to FIGS. 5 to 12 (and with specific reference to FIG. 6A, which illustrates the bottomhole assembly disposed within a wellbore string 11) the bottomhole assembly 100 is deployable within the wellbore 104, through the wellbore string passage 2 of the wellbore string 11, on a workstring 800. Suitable workstrings include tubing string, wireline, cable, or other suitable suspension or carriage systems. Suitable tubing strings include jointed pipe, concentric tubing, or coiled tubing. The workstring includes a fluid passage, extending from the surface, and disposed in, or disposable to assume, fluid communication with a passage 2021 of the bottomhole assembly (see below). The deployed tool includes the bottomhole assembly 100 and the workstring 800.

The workstring 800 is coupled to the bottomhole assembly 100 such that forces applied to the workstring 200 are transmitted to the bottomhole assembly 100 to actuate displacement of the flow control member 16.

While the bottomhole assembly 100 is deployed through the wellbore string passage 2 (and, therefore, through the wellbore 104), an intermediate (or annular) region 112 is defined within the wellbore string passage 2 between the bottomhole assembly 100 and the wellbore string 11.

In some embodiments, for example, the bottomhole assembly 100 includes an uphole assembly portion 200, a downhole assembly portion 300, an actuatable sealing member 502, an uphole actuator 504, a downhole actuator 506, a locating mandrel 600, and a shifting tool 700. The uphole assembly portion 200 includes a housing 201, a passage 202, and a valve plug 210. The downhole assembly portion 300 includes a fluid distributor 301 and a shifting tool mandrel 320. The passage 202 of the uphole assembly portion 200 is disposed in fluid communication with the fluid distributor via ports 203 disposed within the housing 201.

The fluid distributor 301 includes ports 302 and 304. A valve seat 306 is defined within the fluid distributor, and includes an orifice 308. The valve seat 306 is configured to receive seating of the valve plug 210. While the valve plug 210 is unseated relative to the valve seat 406, fluid communication, via the orifice 308, is effected between the ports 302 and 304. While the valve plug 210 is seated on the valve seat 306, fluid communication between the ports 302 and 304, via the orifice 306, is sealed or substantially sealed.

While: (i) the bottomhole assembly 100 is deployed within the wellbore 104, (ii) the valve plug 210 is unseated relative to the valve seat 306, and (iii) the sealing member 502 is disposed in sealing engagement or substantially sealing engagement with the flow control member 16 (see below), the port 304 effects fluid communication, via the orifice 308, between the uphole wellbore portion 108 (such as, for example, the annular region 112) and the downhole wellbore portion 106.

The valve plug 210 of the uphole assembly portion 200 is configured for sealingly, or substantially sealingly, engaging the valve seat 306 and thereby sealing fluid communication or substantially sealing fluid communication between the uphole and downhole wellbore portions 108, 106 via the orifice 308. The combination of the valve plug 210 and the fluid distributor 301 define the equalization valve 400.

The equalization valve 400 is provided for at least controlling fluid communication between: (i) an uphole wellbore portion 108 (such as, for example, the annular region 112 between the wellbore string and the bottomhole assembly) that is disposed uphole relative to the sealing member 502, and (ii) a downhole wellbore portion 106 that is disposed downhole relative to the sealing member 502, while the sealing member 502 is actuated and disposed in a sealing, or substantially sealing, relationship with the wellbore string 11 (see below).

In this respect, while the sealing member 502 is sealingly, or substantially sealingly, engaging the wellbore string 11 (see below), the equalization valve 400 is disposable between at least two conditions:

(a) a downhole isolation condition, wherein fluid communication, between the uphole annular region portion 112 and the downhole wellbore portion 106, is sealed or substantially sealed (see FIG. 7), and (b) a depressurization condition, wherein the uphole wellbore portion 108 (such as, for example, the annular region 112 between the wellbore string and the bottomhole assembly) is disposed in fluid communication, with the downhole wellbore portion 106 (see FIGS. 5, 6 and 8), such as, for example, for effecting depressurization of the uphole wellbore portion 108.

While the equalization valve 400 is disposed in the downhole isolation condition, the valve plug 210 is disposed in the downhole isolation position such that the valve plug 210 is disposed in sealing engagement with the valve seat 306 and sealing, or substantially sealing fluid communication between the uphole and downhole wellbore portions 108, 106 via the orifice 308 and the port 304. While the equalization valve 400 is disposed in the depressurization condition, the valve plug 210 is disposed in the depressurization position such that the valve plug 210 is spaced apart from the valve seat 306 such that fluid communication is effected between the uphole and downhole wellbore portions 108, 106 via the orifice 308 and the port 304.

The uphole assembly portion 200, including the valve plug 210, is displaceable relative to the valve seat 306. The uphole assembly portion 200, including the valve plug 210, is connected to and translatable with the workstring 800 such that displaceability of the uphole assembly portion 200 (and, therefore, the valve plug 210), relative to the valve seat 306, in response to forces that are being applied to the workstring 800, between a downhole isolation position, corresponding to disposition of the equalization valve 400 in the downhole isolation condition, and a depressurization position, corresponding to disposition of the equalization valve 400 in the depressurization condition.

The displacement of the valve plug 210 from the depressurization position to the downhole isolation position is in a downhole direction. Such displacement is effected by application of a compressive force to the workstring 800, which is transmitted to the valve plug 210. Downhole displacement of the valve plug 210, relative to the valve seat 306 is limited by the valve seat 306 upon contact engagement between the valve plug 210 and the valve seat 306.

The displacement of the valve plug 210 from the downhole isolation position to the depressurization position is in an uphole direction. Such displacement is effected by application of a tensile force to the workstring 800, which is transmitted to the valve plug 210. Uphole displacement of the valve plug 210 (and, therefore, the uphole assembly portion 200), relative to the valve seat 306, is limited by a shoulder 310 that is defined within the fluid distributor 301. In this respect, the limiting of the uphole displacement of the valve plug 210, relative to the valve seat 306, is effected upon contact engagement between an engagement surface 211 of the uphole assembly portion 200 and the shoulder 310.

While the bottomhole assembly 100 is disposed within the wellbore 104 and connected to the workstring 800, the passage 202 is fluidly communicable with the wellhead via the workstring 800 and is also fluidly communicable with the fluid distributor. The passage 202 is provided for, amongst other things, (i) effecting downhole flow of fluid perforating agent to the perforating device 224 for effecting perforation of the wellbore string 11; (ii) effecting downhole flow of fluid for effecting actuation of the hydraulic hold down buttons of the second shifting tool (see below); and (iii) and flushing of the wellbore 8 by uphole flow of material from the uphole annular region 212 and via the port 302 (such flow being initiated by downhole injection of fluid through the uphole annular region 112 while a sealing interface is established for sealing or substantially sealing fluid communication between the uphole and downhole wellbore portions 108, 106, such sealing interface being established, for example, by the combination of at least the sealing engagement or substantially sealing engagement between the sealing member 502 and the wellbore string 11 and the seating of the valve plug 210 on the valve seat 306 and thereby sealing or substantially sealing the orifice 308—see below). In some embodiments, for example, and where a check valve 222 is not provided (see below), the passage 202 could also be used for effecting flow of treatment material to the subterranean formation 102 (by receiving treatment material supplied by the workstring 800, such as, for example, a coiled tubing) via the port 302.

A check valve 222 is disposed within the passage 202, and configured for preventing, or substantially preventing, flow of material in a downhole direction from the surface. The check valve 222 seals fluid communication or substantially seals fluid communication between an uphole portion 202A of the passage 202 and the uphole annular region portion 112 (via the fluid conductor ports 302) by sealingly engaging a valve seat 2221, and is configured to become unseated, to thereby effect fluid communication between the uphole annular region portion 112 and the uphole portion 202A, in response to fluid pressure within the uphole annular region portion 108 exceeding fluid pressure within the uphole portion 202A. In this respect, the check valve 222 permits material to be conducted through the passage 201 in an uphole direction, but not in an downhole direction. In some implementations, for example, and as referred to above, the material being supplied downhole through the annular region 112 includes fluid for effecting reverse circulation (in which case, the above-described sealing interface is established), for purposes of removing debris from the annular region 112, such as after a "screen out", and the check valve permits such reverse circulation. In some embodiment, for example, the check valve 222 is in the form of a ball that is retained within a portion of the passage 201 by a retainer 2223.

The shifting tool mandrel 320 extends from the fluid distributor 301. In some embodiments, for example, the shifting tool mandrel 320 further includes a bullnose centralizer 322 for centralizing the bottomhole assembly 100.

The actuatable sealing member 502 is supported on the shifting tool mandrel 320 and configured for becoming disposed in sealing engagement with the wellbore string 11, such that, in combination with the sealing, or substantially sealing, engagement between the valve plug 210 and the valve seat 306, the sealing interface is defined between the uphole and wellbore portion 108, 106. The sealing member 502 is configured to be actuated into sealing engagement with the flow control member 16, in proximity to a port 14 that is local to a selected treatment material interval, while the assembly 100 is deployed within the wellbore 104 and has been located within a predetermined position at which fluid treatment is desired to be a delivered to the formation. In this respect, the sealing member 502 is displaceable between at least an unactuated condition (see FIGS. 5, 6 and 8) and a sealing engagement condition (FIG. 7). In the unactuated condition, the sealing member 502 is spaced apart (or in a retracted state) relative to the flow control member 16. In the sealing engagement condition, the sealing member 502 is disposed in sealing, or substantially sealing, engagement with the flow control member 16, while the assembly 100 is deployed within the wellbore 104 and has been located within a predetermined position at which fluid treatment is desired to be a delivered to the formation 102. The sealing engagement is with effect that fluid communication through the annular region 112, between the shifting tool mandrel 320 and the wellbore string 11, and between the treatment material interval and a downhole wellbore portion 106, is sealed or substantially sealed. In some embodiments, for example, the sealing member 502 includes a packer.

The locating mandrel 600 is disposed about the shifting tool mandrel 320 (in some embodiments, for example, the shifting tool mandrel 320 extends through the locating mandrel 600 and is displaceable through the locating mandrel 600) and includes an engagement feature 602 (such as, for example, a protuberance, such as a locator block 602, for releasably engaging a locate profile 11A within the wellbore string 11. The releasable engagement is such that relative displacement between the locating mandrel 600 and the locate profile 11A is resisted. In some embodiments, for example, the resistance is such that the locating mandrel 600 is releasable from the locate profile 602 in response to the application of a minimum predetermined force, such as a force transmitted from the workstring 800 (see below).

In some embodiments, for example, the locating mandrel 600 includes a gripper retaining portion 600A and a locator portion 600B. The gripper retaining portion 600A is connected to the locator portion 600B with an adapter 600C.

The locating mandrel 600 (and, more specifically, the locator portion 600B) includes a collet 604, with the locator block 602 attached to the collet 604. In some embodiments, for example, the collet 604 includes one or more collet springs 606 (such as beam springs) that are separated by slots. In some contexts, the collet springs 606 may be referred to as collet fingers. In some embodiments, for example, a locator block 602 is disposed on each one of one or more of the collet springs 606. In some embodiments, for example, the locator block 602 is defined as a protuberance on the collet spring 606.

In some embodiments, for example, the collet springs 606 are configured for a limited amount of radial compression in response to a radially compressive force. In some embodiments, for example, the collet springs 606 are configured for a limited amount of radial expansion in response to a radially expansive force. Such compression and expansion enable the collet springs 606 to pass by a restriction in a wellbore 104 while returning to its original shape, while still exerting some drag force against the wellbore string 11 and, in this way, opposing the travel of the bottom hole assembly 100 through the wellbore 104.

In this respect, in some embodiments, for example, the collet springs 606 exerts a biasing force such that, when the locator block 602 becomes positioned in alignment with the locate profile 11A, the resiliency of the collet springs urges the locator block 602 into disposition within the locate profile, thereby "locating" the bottomhole assembly 100. While the locator block 602 is releasably engaged to the locate profile 11A, the biasing force is urging the locator block 602 into the releasable engagement.

The locating mandrel 600 is coupled (such as, for example, threaded) to a clutch ring 620. The clutch ring 620 is rotationally independent from the locating mandrel 600 and translates axially with the locating mandrel 600. A cam actuator or pin 622 extends from the clutch ring, and is disposed for travel within a j-slot 324 (see FIG. 10) formed within the shifting tool mandrel 320, such that coupling of the locating mandrel 600 to the shifting tool mandrel 320 is effected by the disposition of the pin 622 within the j-slot 324. The coupling of the locating mandrel 600 to the shifting tool mandrel 320 is such that relative displacement between the locating mandrel 600 and the shifting tool mandrel 320 is guided and defined by interaction between the pin 622 and the j-slot 324.

The shifting tool 700 includes a gripper 700A. The gripper 700A is slidably mounted over and supported by the mandrel 320. In this respect, in some embodiments, for example, the gripper 700A includes a collar 702 through which the mandrel 320 extends and is displaceable relative to the gripper 700A. In some embodiments, for example, the gripper 700A includes a rocker. In some embodiments, for example, the gripper includes a plurality of bidirectional slips that are coupled to one another (such as, for example, by a retaining spring 710 (see below), such that the collar 702 is defined.

The gripper 700A includes a first gripper surface 706 disposed closer to a first end 706A than a second end 708B, and a second gripper surface 708 disposed closer to the second end 708B than the first end 708A. In this respect, the gripper 700A is rotatable relative to the shifting tool mandrel 320 such that rotation in a first direction effects displacement of the first gripper surface 706 away (such as, for example, radially) from mandrel 320, from a first gripper surface-retracted position to a first gripper surface-actuated position, and such that rotation in a second direction, that is counter to the first direction, effects displacement of the second gripper surface 708 away (such as, for example, radially) from the mandrel 320, from a second gripper surface-retracted position to a second gripper surface-actuated position.

In those embodiments where the gripper 700A includes a rocker, in some of these embodiments, for example, the first gripper surface 706 is disposed closer to one end of the rocker relative to a second opposite end of the rocker, and the second gripper surface 708 is disposed closer to the second end of the rocker relative to the first end.

In some embodiments, for example, for at least one of the first and second gripper surfaces 706, 708 (in the illustrated embodiment, this is for the second gripper surface 708 only), the locating mandrel 600 includes an aperture 632 through which the gripper surface (and in the illustrated embodiment, the gripper surfaces 708 of the plurality of bidirectional slips) is displaceable in response to the urging by the respective one of the first and second shifting tools 504, 506.

The gripper 700A is biased towards a retracted position, wherein both of the first gripper surface 706 and the second gripper surface 708 are disposed in their respective retracted positions. The biasing of the gripper is effected by a retaining spring 710 disposed within a groove 712 of the collar 702 and about the shifting tool mandrel 320.

The first gripper surface 706 is actuatable from the first gripper surface-retracted position to the first gripper surface gripping position by a first gripper actuator 504. In the first gripper surface gripping position, the first gripper surface 706 is oriented to transmit an applied force (such as, for example, that being applied by a pressurized fluid) to the flow control member 16 for effecting downhole displacement of the flow control member 16 relative to the port 14. The first gripper actuator 504 is mounted to (such as, for example, movably mounted) and supported on the shifting tool mandrel 320. In some embodiments, for example, the first gripper actuator 504 includes a setting pin 5045 that is threaded to a first setting cone 5041. The first gripper actuator 504 is displaceable downhole in response to application of a compressive force to the workstring 800, that is transmitted by the fluid distributor 301 to the first gripper actuator 504 via the seating of the valve plug 210 on the valve seat 306.

The second gripper surface 708 is actuatable from the second gripper surface-retracted position to the second gripper surface gripping position by a second gripper actuator 506. In the second gripper surface gripping position, the second gripper surface 708 is oriented to transmit an applied force (such as, for example, that being applied by the second gripper actuator 506) to the flow control member 16 for effecting uphole displacement of the flow control member 16 relative to the port 14. The second gripper actuator 506 is mounted to and supported on the shifting tool mandrel 320. In some embodiments, for example, the second gripper actuator 506 is retained to the shifting tool mandrel 320 (such as, for example, in the illustrated embodiment, by shear pins) such that the second gripper actuator 506 is translatable with the shifting tool mandrel. 320. The second gripper actuator 506 includes a second setting cone 5061. The second gripper actuator 506 is displaceable uphole in response to application of a pulling up force to the workstring 800 that is transmitted by the fluid distributor 301 to the shifting tool mandrel 320, via engagement between the engagement surface 211 and the shoulder 310, resulting in uphole displacement of the shifting tool mandrel 320 (thereby also resulting in the uphole translation of the second gripper actuator 506).

The gripper 700A is co-operatively disposed relative to the locating mandrel 600, such that: (a) the gripper 700A is displaceable in response to urging by the first gripper actuator 504, that is effected by downhole displacement of the shifting tool mandrel 320 relative to the locating mandrel 600 (such as, for example, displacement of the shifting tool mandrel 320 along its longitudinal axis in a first direction), such that the first gripper surface 706 is displaced outwardly to a first gripper surface gripping position for becoming disposed in gripping engagement with the flow control member 16, and (b) the gripper 700A is displaceable in response to urging by the second gripper actuator 506, that is effected by uphole displacement of the shifting tool mandrel 320 relative to the locating mandrel 600 (such as, for example, displacement of the shifting tool mandrel 320 along its longitudinal axis in a second direction, wherein the second direction is opposite, or substantially opposite, to the first direction), such that the second gripper surface 708 is displaced outwardly to a second gripper surface gripping position for becoming disposed in gripping engagement with the flow control member 16.

In some embodiments, for example, the outwardly displacement of the first gripper surface 706 to the first gripper surface gripping position is outwardly (e.g. radially outwardly) relative to the shifting tool mandrel 320, and the outwardly displacement of the second gripper surface 708 to the second gripper surface gripping position is outwardly (e.g. radially outwardly) relative to the shifting tool mandrel 320.

In some embodiments, for example, the movement of the first gripper surface 706, during the outwardly displacement of the first gripper surface 706 to the first gripper surface gripping position, includes a rotational component, and the movement of the second gripper surface 708, during the outwardly displacement of the second gripper surface to the second gripper surface gripping position, includes a rotational component. In this respect, during the outwardly displacement of the first gripper surface 706 to the first gripper surface gripping position, movement of the first gripper surface 706 includes a rotational movement, and during the outwardly displacement of the second gripper surface 708 to the first gripper surface gripping position, movement of the second gripper surface 708 includes a rotational movement. In some embodiments, for example, the rotational movement of the second gripper surface 708 during the outwardly displacement of the second gripper surface 708 to the second gripper surface gripping position is counter to the rotational movement of the first gripper surface 706 during the outwardly displacement of the first gripper surface 706 to the first gripper surface gripping position.

In some embodiments, for example, the displacement of the first gripper surface 706 to the gripping position is such that the first gripper surface 706 becomes disposed for transmitting a force, being applied in a downhole direction, to the flow control member 16 for effecting downhole displacement of the flow control member 16 relative to the port 14. Similarly, the displacement of the second gripper surface 708 to the gripping position is such that the second gripper surface 708 becomes disposed for transmitting a force, being applied in an uphole direction, to the flow control member 16 for effecting uphole displacement of the flow control member 16 relative to the port 14.

In some embodiments, for example, the locating mandrel 600 includes a retainer 650 for limiting of displacement of the gripper 700A in both of downhole and uphole directions relative to the locating mandrel 600. In the illustrated embodiment, for example, the retainer 650 depends from an inner surface of the locating mandrel 600 for effecting opposition to both of uphole and downhole displacements of the gripper 700A, such retainer being positioned within the groove 712 of the gripper 700A. In some embodiments, for example, the retainer includes a first shoulder having a first retainer surface that is disposed for opposing displacement of the gripper 700A, relative to the locating mandrel 600, in a downhole direction, and a second shoulder having a second retainer surface that is disposed for opposing displacement of the gripper 700A, relative to the locating mandrel 600, in an uphole direction. In some embodiments, for example, each one of the first and second retainer surfaces, independently, is transverse to the axis of the locating mandrel 600. In some embodiments, for example, the co-operative disposition of the gripper 700A relative to the locating mandrel 600, which lends itself to the outwardly displacement of the first gripper surface 706, in response to the urging of the first gripper actuator 504, and also which lends itself to the outwardly displacement of the second gripper surface 708, in response to the urging of the second gripper actuator 506 includes the above-described retention of the gripper 700A by the retainer 650.

In some embodiments, for example, the displacement of the gripper 700A, for which the retainer 650 is configured for limiting, is a longitudinal displacement of the gripper 700A. In some embodiments, for example, the downhole displacement of the gripper 700A, for which the retainer 650 is configured for limiting, is a displacement in a first direction that is parallel or substantially parallel to the longitudinal axis of the wellbore, the longitudinal axis of the second mandrel, or both of the longitudinal axis of the wellbore and the longitudinal axis of the locating mandrel 600. In some embodiments, for example, the uphole displacement of the gripper 700A, for which the retainer 650 is configured for limiting, is a displacement in a second direction that is parallel or substantially parallel to the longitudinal axis of the wellbore, the longitudinal axis of the locating mandrel 600, or both of the longitudinal axis of the wellbore and the longitudinal axis of the locating mandrel 600. The second direction is opposite, or substantially opposite, to the first direction.

In some embodiments, for example, engageablity of the first gripper actuator 504 with the gripper 700A, for effecting the outwardly displacement of the first gripper surface 706 to the first gripper surface gripping position, in response to the compression of the workstring 800, is determined based upon positioning of the pin 622 relative to the j-slot 324. Depending on the position of the pin 622 within the j-slot, compression of the workstring effects sufficient displacement of the shifting tool mandrel 320 relative to the locating mandrel, and, therefore also effects sufficient displacement of the first gripper actuator 504 relative to the gripper 700A, such that the first gripper actuator 504 becomes engaged to the gripper 700A for effecting the actuation of the first gripper surface 706. For example, compression of the workstring 800, while the pin 622 is positioned within the j-slot between position 324D and position 324A, will not result in the engagement of the first gripper actuator 504 with the gripper 700A (and, therefore, the actuation of the first gripper surface 704), as the permitted longitudinal displacement of the shifting tool mandrel 320 relative to the locating mandrel 600, corresponding to the longitudinal displacement of the pin 622 within the j-slot, is insufficient to effect engagement between the first gripper actuator 504 and the gripper 700A. Rather the shifting tool actuator 504 will remain spaced apart from the gripper 700A. On the other hand, compression of the workstring 800, while the pin 622 is positioned within the j-slot between position 324B and position 324C, will result in the engagement of the first gripper actuator 504 with the gripper 700A, with effect that the first gripper surface 706 will become actuated, as the permitted longitudinal displacement of the shifting tool mandrel 320 relative to the locating mandrel 600, corresponding to the longitudinal displacement of the pin 622 within the j-slot, is sufficient to effect this engagement.

Similarly, engageablity of the second gripper actuator 506 with the gripper 700A, for effecting the outwardly displacement of the second gripper surface 708 to the second gripper surface gripping position, in response to the pulling up of the workstring 800, is also determined based upon positioning of the pin 622 relative to the j-slot 324. Depending on the position of the pin 622 within the j-slot, pulling up of the workstring effects sufficient displacement of the shifting tool mandrel 320 relative to the locating mandrel, and, therefore also effects sufficient displacement of the second gripper actuator 506 relative to the gripper 700A, such that the second gripper actuator 506 becomes engaged to the gripper 700A for effecting the actuation of the second gripper surface 708. For example, pulling up of the workstring 800, while the pin 622 is positioned within the j-slot between position 324A and position 324B, will not result in the engagement of the second gripper actuator 506 with the gripper 700A (and, therefore, the actuation of the second gripper surface 706), as the longitudinal displacement of the shifting tool mandrel 320 relative to the locating mandrel 600, corresponding to the longitudinal displacement of the pin 622 within the j-slot, is insufficient to effect engagement between the second gripper actuator 506 and the gripper 700A. Rather the second gripper actuator 506 will remain spaced apart from the gripper 700A. On the other hand, pulling up of the workstring 800, while the pin 622 is positioned within the j-slot between position 324C and position 324D, will result in the engagement of the second gripper actuator 506 with the gripper 700A, with effect that the second gripper surface 708 will become actuated, as the permitted longitudinal displacement of the shifting tool mandrel 320 relative to the locating mandrel 600, corresponding to the longitudinal displacement of the pin 622 within the j-slot, is sufficient to effect this engagement.

One or more terminuses are defined within the j-slot 324, and configured to receive the pin 622. Disposition of the pin 622 at pin position 324A is such that the pin 622 is disposed at a terminus of the j-slot 324, and relative displacement between the shifting tool mandrel 320 and the locating mandrel 600, in response to a compressive force applied to the workstring 800, is thereby prevented such that the first gripper actuator 504 remains spaced apart from the gripper 700A, and such that the first gripper surface 706 is not actuated and remains disposed in the retracted position. Disposition of the pin 622 at pin position 324B is such that the pin 622 is disposed at a terminus of the j-slot 324, and relative displacement between the shifting tool mandrel 320 and the locating mandrel 600, in response to a pulling up force applied to the workstring 800, is thereby limited such that the second gripper actuator 506 remains spaced apart from the gripper 700A, and such that the second gripping surface 708 is not actuated by the actuator 506 and remains disposed in the retracted position.

By maintaining the shifting tool actuators 504, 506 in spaced-apart relationship relative to the gripper 700A, application of forces to the workstring 800 to effect manipulation of the bottom hole assembly 100, without effecting actuation of the gripper 700, is enabled. This may be desirable, for example, while attempting to locate the bottom hole assembly 100 within the wellbore.

In some embodiments, for example, the shifting tool mandrel 320 includes an outermost surface 3202 having a plurality of debris relief apertures 3203 extending through the outermost surface 3202 to the passage 3201, which extends remotely of the fluid distributor 301 relative to both of the first and second shifting tools 504, 506. While the bottomhole assembly 100 is disposed within the wellbore 2, the debris relief aperture 3203 effect flow communication between the passage 3201 and the wellbore 2 such that a pathway is provided for sold debris (e.g. sand), which has become disposed within the wellbore 2, to be conducted remotely of movable components of the bottomhole assembly via the passage 3201, by communication with the passage 3201 via the debris relief apertures 3203, thereby mitigating accumulation of solid debris proximate to movable components of the bottomhole assembly 100, which could interfere with operation of the bottomhole assembly. Because the passage 3201 is communicable with the flow distributor 301 when the valve plug 210 is unseated relative to the valve seat 306, the passage 3201 may be flushed downhole with fluid communicated by the flow distributor 301 to the passage 3201. In some embodiments, for example, one or more of the debris relief apertures 3203 of the shifting tool mandrel 320 are disposed in alignment with the gripper 700A.

Relatedly, in some embodiments, for example, the setting cone 5041 of the first gripper actuator 504 includes debris relief apertures 5042 extending through an outermost surface 5043 of the setting cone 5041 into a space disposed between setting cone 5041 and the shifting tool mandrel 320, and one or more of debris relief apertures 3202 of the shifting tool mandrel 320 are disposed in alignment with the space disposed between the setting cone 5041 and the shifting tool mandrel 320. In this respect, flow communication between the wellbore 2 and the passage 3201 is effected via the debris relief apertures 5042, the space disposed between the setting cone 5041 and the shifting tool mandrel 320, and the debris relief apertures 3202, thereby provide for a pathway for conducting solid debris, that is accumulating in proximity to the setting cone 5041, downhole via the passage 3201. Similarly, in some embodiments, for example, the setting cone 5061 includes corresponding debris relief apertures 5062 extending through an outermost surface 5063 of the setting cone 5061, and one or more of the debris relief apertures 3202 of the shifting tool mandrel 320 are disposed in alignment with the space between the setting cone 5061 and the shifting tool mandrel 320.

Also relatedly, in some embodiments, for example, the locating mandrel 600 includes debris relief apertures 640 extending through an outermost surface 642 of the locating mandrel 600 for effecting flow communication with the external wellbore 2 and the space between the locating mandrel 600 and the shifting tool mandrel 320, and one or more of the debris relief apertures 3202 of the shifting tool mandrel 320 are disposed in alignment with the space between the locating mandrel 600 and the shifting tool mandrel. In some embodiments, for example, the debris relief apertures are positioned in alignment with the gripper 700A. This configuration is for providing a pathway for conducting solid debris, that is accumulating in proximity to the locating mandrel 600, downhole via the passage 3201.

While the bottomhole assembly 100 is disposed within the wellbore string 11 and has been located within the wellbore string with the locator block 602 of the locating mandrel 600 being disposed within the locate profile 11A (thereby restricting displacement of the locating mandrel 600 relative to the wellbore string 11), and the pin 622 is disposed between position 324B and position 342C, the actuation of the first gripper surface 706 is effectible by downhole displacement of the first gripper actuator 506, relative to the gripper 700A, in response to a compressive force exerted on the workstring 800. The applied compressive force is transmittable by the first gripper actuator 504 to the gripper 700A. Because of the above-described position of the pin 622 within the j-slot 324, in response to the compressive force applied to the workstring 800, the downhole assembly portion 300 is displaceable downhole, relative to the locating mandrel 600 (and, therefore, the gripper 700A), by the transmission of the applied compressive force by the valve plug 210 to the valve seat 306, while the valve plug 210 is seated on the valve seat 306. The fluid distributor 301 includes a housing having a force transmission surface that is disposed to transmit a force to the sealing member 502 in a downhole direction such that the sealing member 502 becomes translatable downhole with the downhole assembly portion 300. This also means that the sealing member 502 is displaceable downhole relative to the locating mandrel 600 (and, therefore, the gripper 700A) in response to the application of the compressive force to the workstring 800. The sealing member 502 includes a force transmission surface that is disposed to transmit the applied force to the first gripper actuator 506 in a downhole direction such that the first gripper actuator 506 is translatable downhole with the downhole assembly portion 300 and the sealing member 502. This also means that the first gripper actuator 506 is displaceable downhole relative to the locating mandrel 600 (and, therefore, the gripper 700A) in response to the application of the compressive force to the workstring 800. In this respect, the first gripper actuator 506 is displaceable downhole relative to the gripper 700A, by a compressive force being applied to the workstring 800. Because the pin 622 is disposed within the j-slot 324 between position 324C and position 324D, the first gripper actuator 506 is displaceable downhole relative to the gripper 700A, by a compressive force being applied to the workstring 800, by a longitudinal displacement sufficient to enable the engagement between the first gripper actuator 504 and the gripper 700A, and thereby become disposed for transmitting an applied compressive force to the gripper 700A and, consequently, to the locating mandrel 600. Because the locator block 602 is disposed within the locate profile 11A and resisting downhole displacement, in response to the transmission of the applied compressive force by the first gripper actuator 506, a reaction force is transmittable by the locating mandrel 600 to the gripper 700A, such that, in combination with the urging by the first gripper actuator 506, the first gripper surface 706 is displaceable (such as, for example, by rotation, or at least in part by rotation) outwardly (such as, for example radially) relative to the mandrel 320, from the first gripper surface-retracted position to the first gripper surface-actuated position. In this respect, actuation of the first gripper surface 708 is effectible in response to the combination of the urging of the first gripper actuator 504 and the resistance to downhole displacement provided by the disposition of the locator block 602 within the locate profile 11A, with effect that the first gripper surface 706 is gripping (or "biting into") the flow control member 16.

As well, the sealing member 502 is compressible between the gripper 700A and the housing of the fluid distributor 301, as the first gripper actuator 706 is driving into the gripper 700A while the locator block is releasably engaged within the locate profile 11A (and thereby transmitting the compressive force, being applied to the workstring 800, to the gripper 700A and receiving the reaction force exerted by the locating mandrel 600 via the gripper 700A), such that the sealing member 502 becomes deformed and with effect that the sealing member 502 becomes disposed in sealing, or substantially sealing, engagement with the flow control member 16. At least the combination of the disposition of the sealing member in sealing engagement or substantially sealing engagement with the flow control member, and the seating of the valve plug 210 on the valve seat 306, establishes the sealing interface. In such disposition, the sealing member 502 is disposed in a set condition.

After actuation, the actuated first gripper surface 706 is configured for effecting opening of the flow control member 16, in response to application of a force to the first gripper surface 706 in a downhole direction that is sufficient to overcome the resistance being provided by the resilient retainer member 18 (such force, for example, can be applied hydraulically, mechanically (such as by the workstring), or a combination thereof). In some embodiments, for example, once the sealing interface is established, and with the equalization valve disposed in the downhole isolation condition, the wellbore can be pressurized uphole of the sealing interface (such as, for example, supplying pressurized fluid via the annular region portion 108), establishing a pressure differential across the sealing interface, and thereby applying a force that is transmitted by the first gripper surface 706 to the flow control member 16 in a downhole direction, thereby effecting displacement of the flow control member 16 from the closed position to an open position such that the port becomes opened for effecting supplying of treatment fluid to the subterranean formation. In parallel, in some embodiments, for example, the locator block 602 becomes displaced from the locate profile 11A.

While the sealing member 502 is disposed in the sealing or substantially sealing engagement condition with the flow control member 16, and while the valve plug 210 is disposed in the downhole isolation position, such that the sealing interface has been established, and while the flow control member 16 is disposed in the open position, treatment material may be supplied downhole and directed to the port 14 (and through the port 14 to the treatment interval) through the uphole annular region portion 108 of the wellbore string passage 2. Without the valve plug 210 effecting the sealing of fluid communication, via the orifice 308, between the uphole annular region portion 108 and the downhole wellbore portion 106 (by being disposed in the downhole isolation position), at least some of the supplied treatment material would otherwise bypass the port 14 and be conducted further downhole from the port 14 via fluid conductor ports 302 to the downhole wellbore portion 106. Also, the check valve 222 prevents, or substantially prevents, fluid communication of treatment material, being supplied downhole through the uphole annular region portion 108, with the uphole passage portion 201A, thereby also mitigating losses of treatment material uphole via the passage 201.

After sufficient treatment fluid has been supplied, the flow control member 16 is displaceable to the closed position, thereby effecting closing of the port 14. The displacement of the flow control member 16 from the open position to the closed position is effected by the second gripper surface 708. In order to effect such displacement, the second gripper surface 708 is displaced from the second gripper surface-retracted position to the second gripper surface-actuated position (i.e. the second gripper surface 708 becomes actuated). The second gripper surface 708 is actuated by the second gripper actuator 506.

The actuation of the second gripper surface 708 by the second gripper actuator 506 is effectible by uphole displacement of the second gripper actuator 506 relative to the gripper 700A in response to application of a pulling up force on the workstring 800 while the pin 622 is disposed within the j-slot between position 324C and position 324D. The pulling up force applied to the workstring is transmittable to the downhole assembly portion 300 after the valve plug 210 has become unseated from the valve seat 306 and has been displaced uphole relative to the valve seat 306 such that the engagement surface 211 has become engaged to the shoulder 310, with effect that the applied pulling up force is transmitted from the workstring 800 to the downhole assembly portion 300 via the engagement of the engagement surface 211 with the shoulder 310. The downhole assembly portion 300, including the shifting tool mandrel 320, is displaceable sufficiently uphole, relative to the locating mandrel 600, in response to receiving transmission of the pulling up force by the downhole assembly portion 300, such that the second gripper actuator 506 becomes engaged to the gripper 700A. Because the pin 622 is disposed between position 324C and position 324D, in response to a pulling up force being applied to the workstring 800, the shifting tool mandrel 320 is movable uphole independently of the locating mandrel 600 by a sufficient longitudinal displacement to effect the engagement of the second gripper actuator 506 and the gripper 700A. Because the second gripper actuator 506 is translatable with the shifting tool mandrel 320, the second gripper actuator 506 is similarly displaceable uphole relative to the locating mandrel 600 in response to receiving transmission of the pulling up force by the downhole assembly portion 300, and, because the gripper 700A is being retained by the locating mandrel 600 (as described above), the second gripper actuator 506 is also sufficiently displaceable uphole relative to the gripper 700A in response to receiving transmission of the pulling up force by the downhole assembly portion 300 such that the second gripper actuator 506 becomes engaged to the gripper 700A. Because the locating block 602 is disposed in frictional engagement with the wellbore string 11 such that the locating block 602 experiences drag from the wellbore string 11, thereby resulting in a resistance to the displacement of the locating mandrel 600 relative to the wellbore string 11, and because the gripper 700A is being retained by the locating mandrel 600 (as above-described), as the pulling up force continues to be applied to the workstring while the second gripper actuator 506 is engaged to the gripper 700A, the second gripper surface 708 is displaceable (such as, for example, by rotation, or at least in part by rotation) outwardly (such as, for example radially) relative to the mandrel 320, from the second gripper surface-retracted position to the second gripper surface-actuated position. In this respect, actuation of the second gripper surface 708 is effectible by the combination of the urging by the second gripper actuator 506 and the fact that the locator block 602 is experiencing drag from the wellbore string 11, with effect that the second gripper surface 708 is gripping (or "biting into") the flow control member 16.

After actuation, the actuated second gripper surface 708 is configured for effecting opening of the flow control member 16, in response to application of a force to the second gripper surface 708 that is sufficient to overcome the resistance being provided by the resilient retainer member 18 (such force, for example, can be applied hydraulically, mechanically (such as by the workstring), or a combination thereof). In some embodiments, for example, the force applied to the second gripper surface 708 is effected by a pulling up force that is applied to the workstring 800 (or is continuing to be applied to the workstring 800 from during the above-described actuation of the second gripper surface 708) and transmitted by the fluid distributor 301 to the shifting tool mandrel 320, via the engagement between the engagement surface 211 and the shoulder 310, resulting in uphole displacement of the shifting tool mandrel 320, with which the second gripper actuator 506 translates, relative to the actuated second gripper surface 708, such that, by virtue of its gripping engagement to the flow control member 16, the pulling up force, being applied to the workstring, is transmittable by the second gripper surface 708 to the flow control member 16, for effecting displacement of the finger tab 18B from (or out of) the open position-defining recess 32 and, after such displacement, displacement of the flow control member 16 from the open position to the closed position.

The following describes an exemplary deployment of the bottomhole assembly 100 within a wellbore 104 within which the above-described apparatus is disposed, and subsequent supply of treatment material to a zone of the subterranean formation 102.

The bottomhole assembly 100 is run downhole through the wellbore string passage 2, past a predetermined position (based on the length of workstring 800 that has been run downhole). The j-slot 324 is configured such that, while the assembly 100 is being run downhole, downhole displacement of the shifting tool mandrel 320 relative to the locating mandrel 600 is limited such that the first gripper actuator 504 is maintained in spaced apart relationship relative to the gripper 700A, such that the first gripper surface 706 is not actuated during this operation. The first gripper actuator 504 is maintained in spaced apart relationship relative to the gripper 700A by interference provided by the pin 622 becoming disposed in position 324A of the j-slot 324. In some embodiments, for example, the configuration of the bottomhole assembly 100 during this operational step is referred to as "run-in-hole" ("RIH") mode (see FIGS. 5A to E).

Once past the desired location, a pulling up force is applied to the workstring 800, and the predetermined position, at which the selected flow control apparatus port 14 is located with the locator block 602. The bottom hole assembly becomes properly located when the locator block 602 becomes disposed within the locate profile 11A within the wellbore string 11. In this respect, the locator block 602 and the locate profile 11A are co-operatively profiled such that the locator block 602 is configured for disposition within and releasable engagement to the locate profile 11A when the locator block 602 becomes aligned with the locate profile 11A. Successful locating of the locator block 602 within the locate profile 11A is confirmed when resistance is sensed in response to upward pulling on the workstring 800. The j-slot 324 is configured such that, after having been run-in-hole such that the pin becomes disposed in position 324A of the j-slot 324, while the assembly 100 is being pulled uphole, uphole displacement of the shifting tool mandrel 320 relative to the locating mandrel 600 is limited by the extent of travel that is permissible for the pin 622 when travelling from the position 324A to the position 324B, such that the second gripper actuator 506 is maintained in spaced apart relationship relative to the gripper 700A, thereby preventing actuation of the second gripper surface 708. In some embodiments, for example, the configuration of the bottomhole assembly 100 during this operational step is referred to as "pull-out-of-hole" ("POOH") mode (see FIGS. 6A to D), with the pin 622 becoming disposed in position 324B of the j-slot 324

Figure 7A:
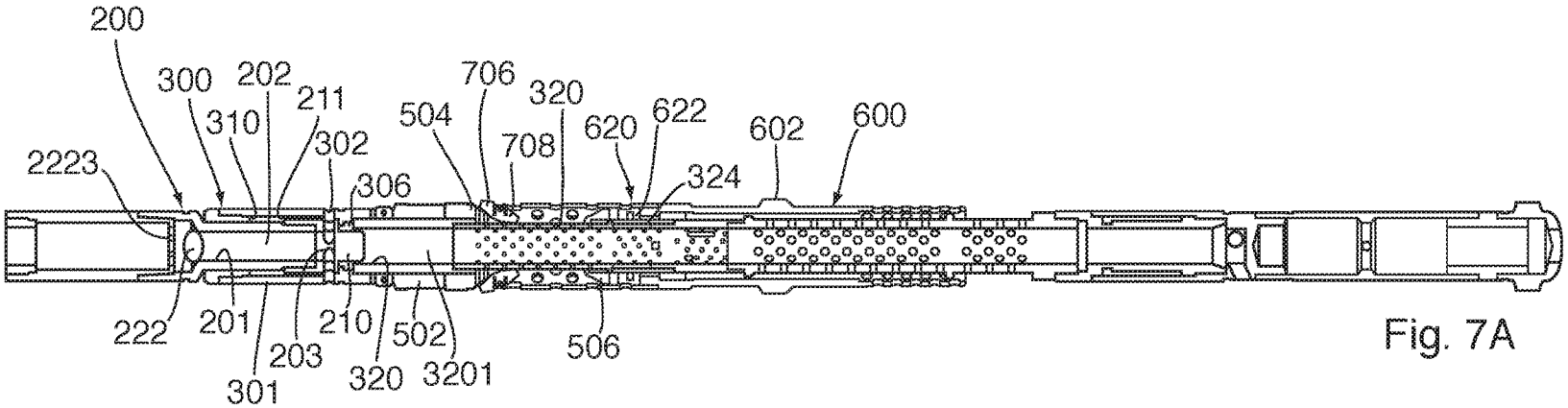
FIGS. 7A and 7B illustrate an embodiment of a bottomhole assembly of the present disclosure, incorporating the flow control apparatus of FIG. 1, in the set down mode, FIG. 7A being a side view, and FIG. 7B being a side sectional view.
Figure 7B:
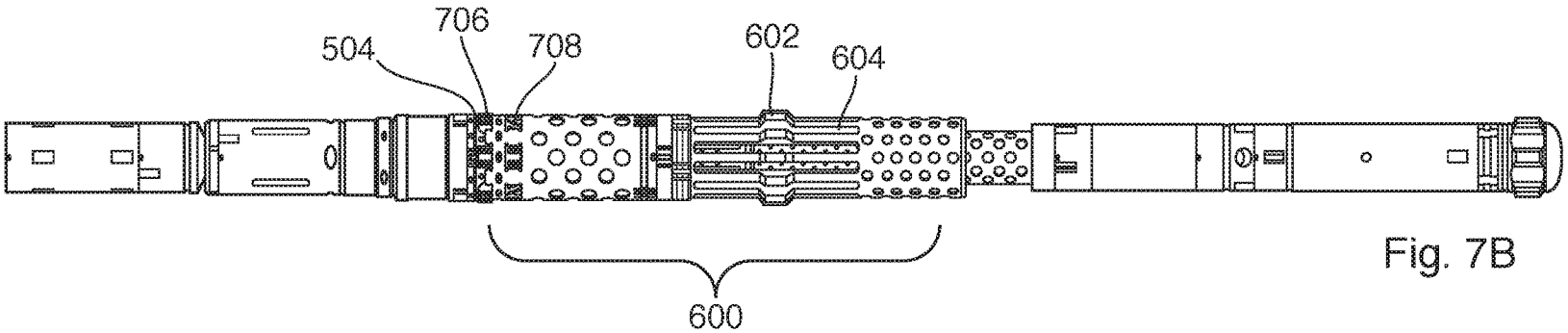
Figure 8A:
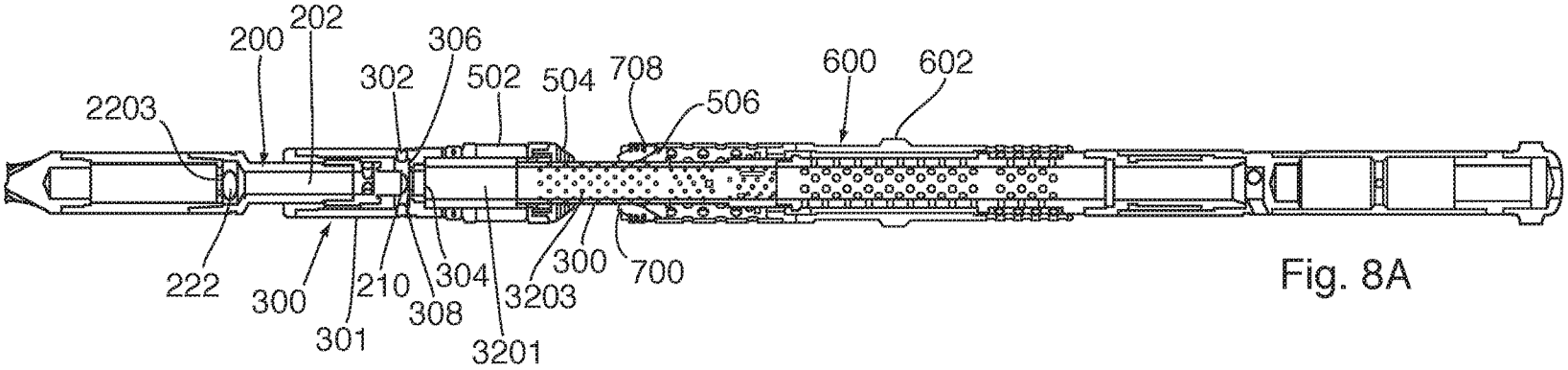
FIGS. 8A and 8B illustrate an embodiment of a bottomhole assembly of the present disclosure, incorporating the flow control apparatus of FIG. 1, in the set up mode, FIG. 8A being a side view, and FIG. 8B being a side sectional view.
Figure 8B:
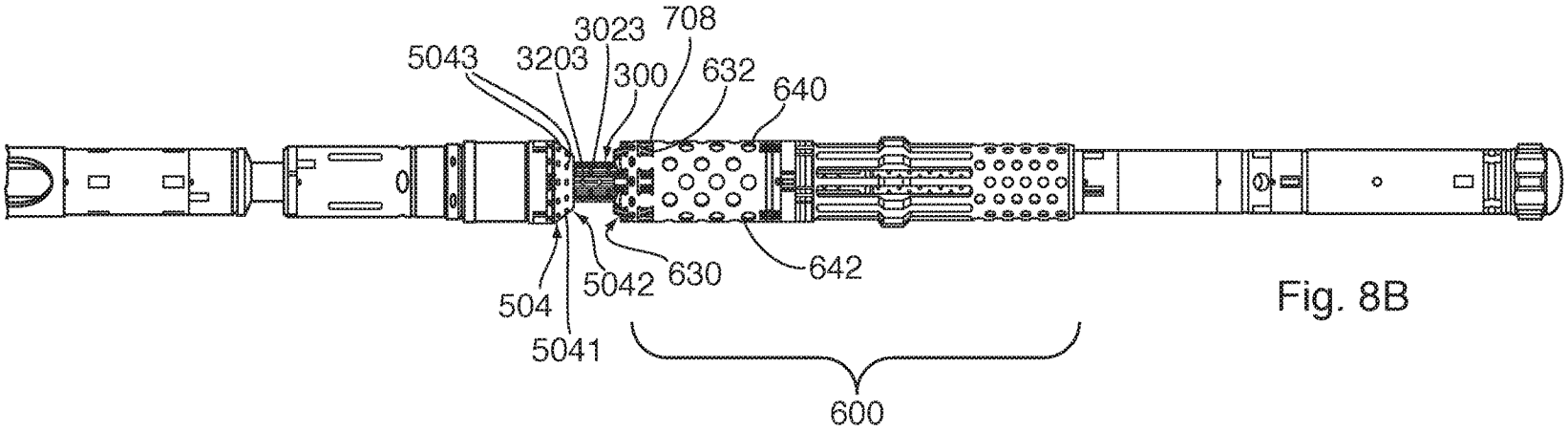
Figure 9A:
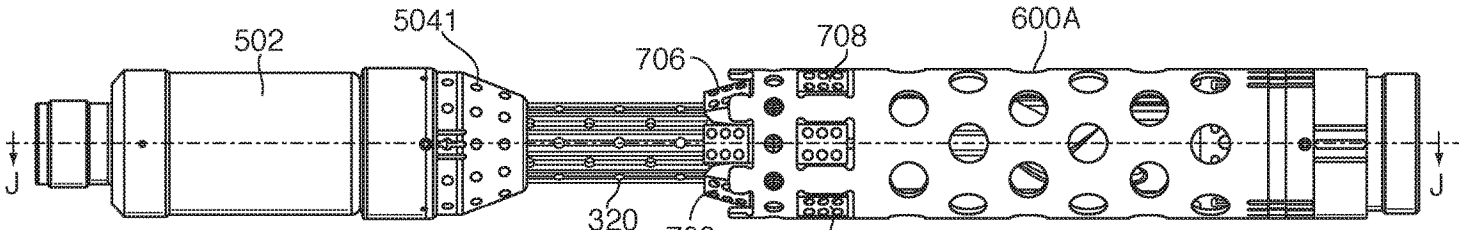
FIGS. 9A, 9B, and 9C illustrate the portion of the bottomhole assembly illustrated in FIGS. 8A to 8E, after the second gripper actuator has been sheared from the shifting tool mandrel, FIG. 9A being a side view of one side of the portion of the bottom hole assembly, FIG. 9B being a sectional side view taken along lines J-J in FIG. 9A, and FIG. 9C being a detailed view of detail K in FIG. 9B.
Figure 9B:
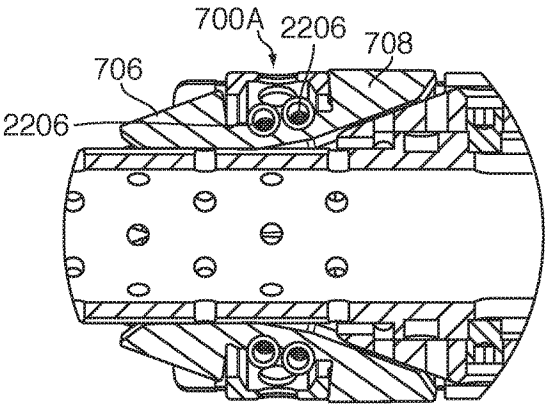
Figure 9C:
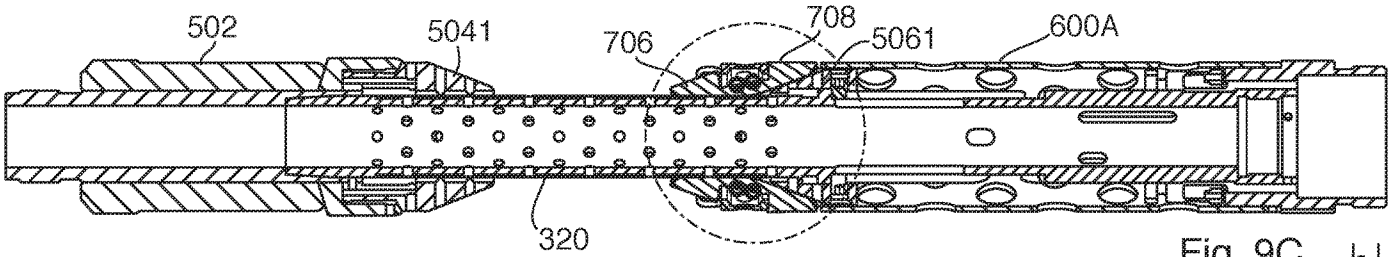
Figure 10:
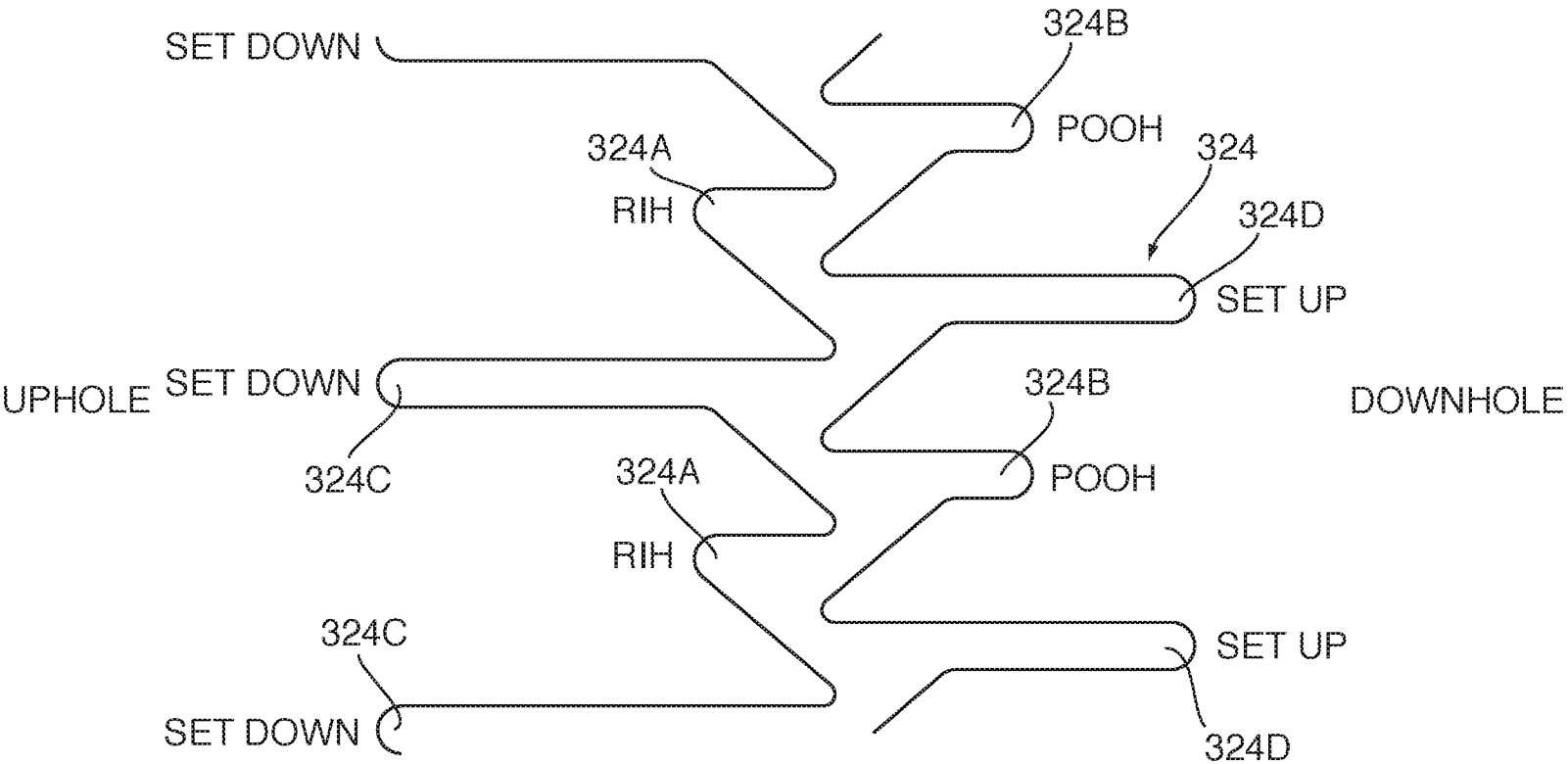
FIG. 10 is an unwrapped view of a j-slot of the embodiment of the bottom hole assembly illustrated in FIGS. 1 to 9.
Figure 11:
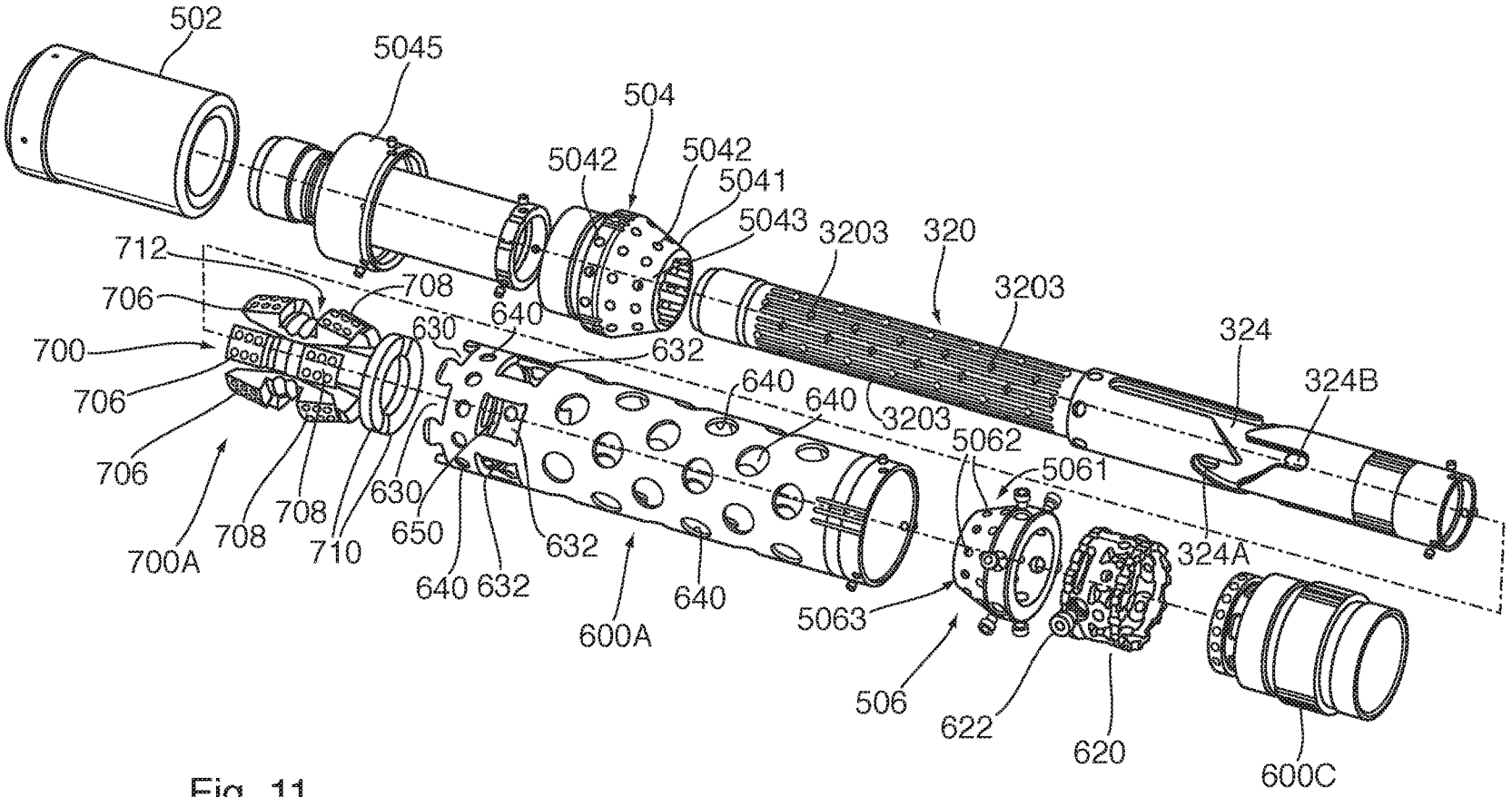
FIG. 11 is an exploded view of a portion of the bottomhole assembly.
Figure 12:
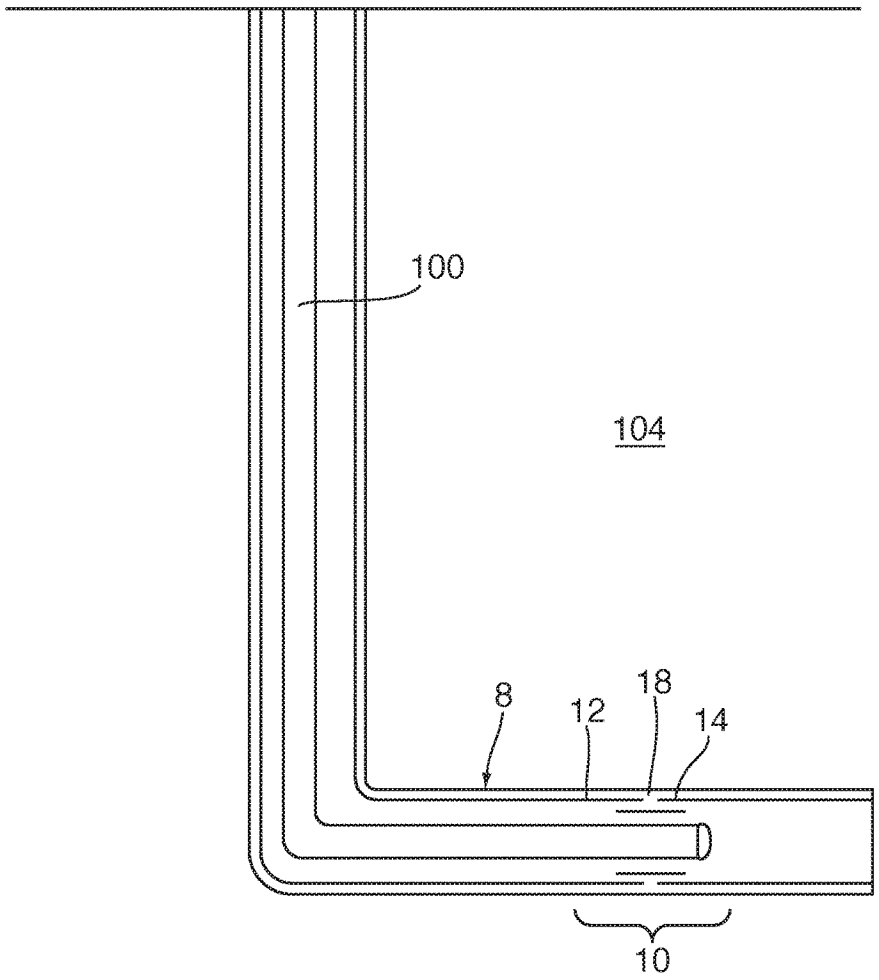
FIG. 12 is a schematic illustration of the bottomhole apparatus of the present disclosure disposed within a wellbore.

Once the bottomhole assembly 100 has been located, the workstring 800 is forced downwardly such that seating of the valve plug 210 with the valve seat 306 is effected. Further compression of the workstring 800 results in the engagement of the first gripper surface 706 by the first gripper actuator 504. This is because the first gripper actuator 504 is able to be displaced a sufficient distance, relative to the first gripper surface 706, so as to become engaged to the first gripper surface 706, by virtue of the corresponding distance that the j-pin is permitted to travel (i.e. from the position 324B to the position 324C within the j-slot 324). Referring to FIG. 7, once the engagement of the first gripper actuator 504 and the first gripper surface 706 is effected, further compression effects actuation of the first gripper surface 706, such that gripping of the flow control member 16 by the first gripper surface 706 is effected, and also effects engagement of the sealing member 502 to the flow control member 16 (as above-described). The seating of the valve plug 210 on the valve seat 306, in combination with the actuation of the sealing member 502, creates the sealing interface. While the workstring 800 continues to be compressed, a pressurized fluid is supplied uphole of the sealing interface from the surface, such as via the annular region 112, with effect that a pressure differential is established across the sealing interface such that shearing of one or more shear pins is effected, the one or more tabs 18B become displaced out of the closed position-defining recess 30 of the flow control member 16 (such as by deflection of the tabs 18B), and the flow control member 16 is displaced from the closed position to the open position (by the force transmitted by the first gripper surface 706), thereby effecting opening of the port 14 and enabling supply of treatment material to the subterranean formation 102 that is local to the flow control apparatus port 14. In parallel, the locator block 602 is displaced from the locate profile 11A, Upon the flow control member 16 being displaced into the open position, the one or more tabs 18B become disposed within the open position-defining recess 32 of the flow control member 16, thereby resisting return of the flow control member 16 to the closed position. In some embodiments, for example, the configuration of the bottomhole assembly 100, during this stage of the process, is referred to as the "set down" mode (see FIGS. 7A to E), with the pin 622 becoming disposed in position 324C of the j-slot 324

Treatment material may then be supplied via the annular region 112 defined between the bottomhole assembly 100 and the wellbore string 11 to the open port 14, effecting treatment of the subterranean formation 102 that is local to the flow control apparatus port 14. The sealing member, in combination with the sealing engagement of the valve plug 210 with the valve seat 306 (i.e. the sealing interface) prevents, or substantially prevents, the supplied treatment material from being conducted downhole, with effect that all, or substantially all, of the supplied treatment material, being conducted via the annular region 112, is directed to the formation 102 through the open port 14.

After sufficient treatment material has been supplied to the subterranean formation 102, supplying of the treatment material is suspended.

In some implementations, for example, after the supplying of the treatment material has been suspended, the flow control member 16 may be returned to the closed position.

In that case, in some of these implementations, for example, prior to effecting displacement of the flow control member 16 from the open position to the closed position with the second gripper surface 708, it may be desirable to depressurize the wellbore uphole of the sealing member 502. In this respect, after the delivery of the treatment material to the formation 102 has been completed, a fluid pressure differential exists across the actuated sealing member (which is disposed in sealing engagement with the flow control member 16), owing to the disposition of the equalization valve 500 in the downhole isolation condition. This is because, when disposed in the downhole isolation condition, the valve plug 210 prevents, or substantially prevents, draining of fluid that remains disposed uphole of the sealing member 502. Such remaining fluid may provide sufficient interference to movement of the flow control member 16 from the open position to the closed position, such that it is desirable to reduce or eliminate the fluid remaining within the annular region 112 and the formation, and thereby reduce or eliminate the pressure differential that has been created across the sealing member, prior to effecting the displacement of the flow control member 16 from the open position to the closed position.

In some of these embodiments, for example, the reduction or elimination of this pressure differential is effected by retraction of the valve plug 210 from the valve seat 306, by pulling uphole on the workstring 800, to thereby effect draining of fluid, disposed uphole of the sealing member 502, in a downhole direction to the downhole wellbore portion 106, via the port 304 and a passage 3201 extending through the shifting tool mandrel 320. In response to the reduction or elimination in the pressure differential, the force urging the sealing member 502 into the engagement with the flow control member 16 is removed or reduced such that the sealing member 502 retracts from the flow control member 16.

The workstring 800 continues to be pulled upwardly such that the engagement surface 211 becomes disposed against the shoulder 310, such that the force is transmitted to the downhole assembly portion 300 via the shoulder 310, effecting displacement of the downhole assembly portion 300, including the shifting tool mandrel 320, relative to the locating tool mandrel 600, such that the first gripper actuator 504 becomes spaced apart from the gripper 700A, resulting in retraction of the first gripper surface 706 from the flow control member 16, owing to the bias of the gripper 700A. This retraction is enabled by the positioning of the pin 622 within the j-slot 324 between position 324C and position 324D, which permits relative displacement between the shifting tool mandrel 320 and the locating mandrel 600 in response to the application of the pulling up force to the workstring 800.

After the retraction of the first gripper surface 706 from the flow control member 16, the workstring 800 continues to be pulled upwardly, resulting in uphole displacement of the shifting tool mandrel 320 relative to the locating mandrel 600 and, therefore, the gripper 700A. This is, again, because the shifting mandrel 320 is movable uphole independently of the locating mandrel 600, by virtue of the pin 622 being disposed within and movable within the j-slot 324 between the position 324C and the position 324D in response to an uphole pulling force being applied to the workstring 800. This uphole displacement is with effect that the second gripper actuator 506 (which translates with the shifting tool mandrel 320) engages the gripper 700A. After the second gripper actuator 506 has engaged the gripper 700A, and while the pulling up force continues to be applied to the workstring 800, because uphole displacement of the locating mandrel 600 (and, therefore, the gripper 700A) is being resisted by the frictional drag exerted by the wellbore string 11 on the locator block 602, the transmission of such force, by the second gripper actuator 506 to the gripper 700A, causes the second gripper surface 708 to be displaced outwardly relative to the shifting tool mandrel 320 and become disposed in gripping engagement with the flow control member 16. In some embodiments, for example, the configuration of the bottomhole assembly 100, during this stage of the process, is referred to as the "set up" mode (see FIGS. 8A to E), with the pin 622 becoming disposed at the position 324D of the j-slot 324.

While the second gripper surface 708 is disposed in gripping engagement with the flow control member 16, the workstring 800 continues to be pulled upwardly, resulting in displacement of the flow control member 16 by the second gripper surface 708.

To continue to the next flow control member 16, the bottom hole assembly 100 is run downhole to cycle the tool back to the RIH mode (see FIGS. 5A to E) to unset the gripper 700A. Once unset, the tool 100 is pulled uphole to the next flow control member 16, for disposition in the POOH mode (see FIGS. 6A to D).

In some embodiments, for example, a plurality of treatment operations is effected sequentially, wherein each one of the treatment operations, independently, includes the opening of a flow control member 16, and, after the opening of the flow control member 16 to effect fluid communication between the wellbore and a corresponding port 14, the supplying of fluid treatment material through the corresponding port 14, and, after sufficient fluid treatment material has been supplied, the closing of the flow control member 16. After the plurality of treatment operations have been effected, the plurality of flow control members 16 may then be re-opened to enable production from the subterranean formation. In order to effect the re-opening, the bottom hole assembly 100 may be deployed downhole and then sequentially opening the flow control members 16 as the bottom hole assembly 100 is progressively pulled uphole. Prior to deployment of the bottom hole assembly to effect the re-opening of the flow control members 16, it is desirable to mitigate accidental re-closing of the flow control members 16, after the flow control members 16 have been re-opened. In some embodiments, for example, to mitigate accidental re-closing, the second gripper actuator 506 is separated from the shifting tool mandrel 320 (such as, for example, by being sheared from the shifting tool mandrel 320) such that the second gripper actuator 506 cannot function to actuate the second gripper surface 708 and then re-close the flow control member 16. In this respect, in some embodiments, for example, after the bottom hole assembly 100 has been deployed within the wellbore and is disposed proximate to the heel of the wellbore, the bottom hole assembly 100 is cycled to the set-up mode (see FIGS. 8A to E) and a tensile load is applied to the workstring 300 sufficient to effect shearing of the second gripper actuator 506 from the shifting tool mandrel 320. In this respect, in some embodiments, for example, the second gripper actuator 506 is retained to the shifting tool mandrel 320 with shear screws 520, and the separation of the second gripper actuator 506 includes shearing of the shear screws. In some embodiments, for example, this is effected by actuating the gripper 700A with the second gripper actuator 506, such that the second gripper surface 708 is actuated and becomes disposed in gripping engagement to a wellbore string portion (such as, for example, a portion of the casing string, but not the flow control member, such as, or example, at or proximate to the heel of the wellbore string) that is immovable, or substantially immovable, while an uphole pulling force is being applied to the workstring 800 and the second gripper surface 708 is gripping the wellbore string portion such that the uphole pulling force is being transmitted to the second gripper surface 708 to the wellbore string portion. After the second gripper surface 708 becomes disposed in gripping engagement with the wellbore string portion, and while the second gripper surface 708 is disposed in gripping engagement with the wellbore string portion, an uphole pulling force is applied to the workstring that is sufficient to effect shearing of the shear pin that is retaining the second gripper actuator 708 to the shifting tool mandrel 320 such that the retention of the second gripper actuator 708 to the shifting tool mandrel 320 is removed (the second gripper actuator 708 is no longer being retained to the shifting tool mandrel 320 with the shear pins. After the shearing of the second gripper actuator 506 from the shifting tool mandrel, the second gripper actuator 506 shifts down such that the second gripper surface 708 is unable to securely engage the flow control member 16 (see FIGS. 9A to C). At this point, the bottom hole assembly 100 is cycled to the RIH mode (see FIGS. 5A to E) and deployment of the bottom hole assembly 100 continues to the bottom of the well, at which point, the bottom hole assembly 100 is cycled to the set-down mode and the flow control members 16 are then opened, one at a time, with a hydraulically applied force.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A bottomhole assembly for deployment within a wellbore string disposed within a wellbore, the wellbore string including a port and a flow control member, wherein the flow control member is displaceable relative to the port for effecting opening and closing of the port, comprising:

a first mandrel;

a second mandrel including a locator for becoming disposed within a locate profile of the wellbore string such that resistance to displacement of the second mandrel, relative to the locate profile, is effected, and such that locating of the second mandrel within the wellbore string is thereby effected;

a shifting tool including a first gripper surface and a second gripper surface;

a first shifting tool actuator, translatable with the first mandrel; and a second shifting tool actuator, translatable with the first mandrel;

wherein the shifting tool is co-operatively disposed relative to the second mandrel such that while the locator is disposed within a locate profile:

displacement of the shifting tool, in response to urging by the first shifting tool actuator that is effected by downhole displacement of the first mandrel relative to the second mandrel, is with effect that the first gripper surface is displaced outwardly to a first gripper surface gripping position for becoming disposed in gripping engagement with the flow control member; and displacement of the shifting tool, in response to urging by the second shifting tool actuator that is effected by uphole displacement of the first mandrel relative to the second mandrel, is with effect that the second gripper surface is displaced outwardly to a second gripper surface gripping position for becoming disposed in gripping engagement with the flow control member.

2. The bottomhole assembly as claimed in claim 1; wherein:

during the outwardly displacement of the first gripper surface to the first gripper surface gripping position, movement of the first gripper surface includes a rotational movement; and during the outwardly displacement of the second gripper surface to the first gripper surface gripping position, movement of the second gripper surface includes a rotational movement.

3. The bottomhole assembly as claimed in claim 2; wherein the rotational movement of the second gripper surface during the outwardly displacement of the second gripper surface to the second gripper surface gripping position is counter to the rotational movement of the first gripper surface during the outwardly displacement of the first gripper surface to the first gripper surface gripping position.

4. The bottomhole assembly as claimed in claim 1; wherein the shifting tool includes a rocker.

5. The bottomhole assembly as claimed in claim 4; wherein:

the first gripper surface is disposed closer to one end of the rocker relative to a second opposite end of the rocker; and the second gripper surface is disposed closer to the second end of the rocker relative to the first end.

6. The bottomhole assembly as claimed in claim 1; wherein:

the downhole displacement of the first mandrel relative to the second mandrel, by which the urging of the first shifting tool actuator, in response to which the shifting tool is displaceable, is effectible, is a longitudinal displacement of the first mandrel along in a first direction; and the uphole displacement of the first mandrel relative to the second mandrel, by which the urging of the second shifting tool actuator, in response to which the shifting tool is displaceable, is effectible, is a longitudinal displacement of the first mandrel in a second direction, wherein the second direction is opposite, or substantially opposite, to the first direction.

7. The bottomhole assembly as claimed in claim 1; wherein:

the first mandrel includes one of a pin and a j-slot;

the second mandrel includes the other one of the-pin and the j-slot, such that the second mandrel is coupled to the first mandrel via disposition of the pin within the j-slot;

the pin is movable within the j-slot;

engageablity of the first shifting tool actuator with the gripper, for effecting the outwardly displacement of the first gripper surface to the first gripper surface gripping position, is determined based upon positioning of the pin relative to the j-slot; and engageablity of the second shifting tool actuator with the gripper, for effecting the outwardly displacement of the second gripper surface to the second gripper surface gripping position, is determined based upon positioning of the pin relative to the j-slot.

8. The bottomhole assembly as claimed in claim 1; wherein, for at least one of the first and second gripper surfaces, the second mandrel includes an aperture through which a one of the at least one of the first and second gripper surfaces is displaceable in response to the urging by the respective one of the first and second shifting tools.

9. The bottomhole assembly as claimed in claim 8; wherein the shifting tool is translatable with the second mandrel.

10. The bottomhole assembly as claimed in claim 1; wherein the shifting tool is biased to the retracted position.

11. The bottomhole assembly as claimed in claim 1; wherein:

the outwardly displacement of the first gripper surface to the first gripper surface gripping position is outwardly relative to the first mandrel; and the outwardly displacement of the second gripper surface to the second gripper surface gripping position is outwardly relative to the first mandrel.

12. The bottomhole assembly as claimed in claim 11; wherein:

movement of the first gripper surface, during the outwardly displacement of the first gripper surface to the first gripper surface gripping position, includes a rotational component; and movement of the second gripper surface, during the outwardly displacement of the second gripper surface to the second gripper surface gripping position, includes a rotational component.

13. The bottomhole assembly as claimed in claim 1; wherein:

the displacement of the first gripper surface to the first gripper surface gripping position is such that the first gripper surface becomes disposed for transmitting a force to the flow control member for effecting downhole displacement of the flow control member relative to the port; and the displacement of the second gripper surface to the second gripper surface gripping position is such that the second gripper surface becomes disposed for transmitting a force to the flow control member for effecting uphole displacement of the flow control member relative to the port.

14. The bottomhole assembly as claimed in claim 1; wherein the shifting tool is supported on the first mandrel.

15. The bottomhole assembly as claimed in claim 1; wherein at least one of the first and the second shifting tool actuators is retained to the first mandrel by at least a shear pin.

16. The bottomhole assembly as claimed in claim 1; wherein;

the second mandrel includes a locator and a collet, wherein the locator is connected to the collet, the locator is configured for becoming disposed within the locate profile such that the disposition of the second mandrel within the locate profile is effected; and the collet is configured to exert a biasing force for urging the locator into disposition within the locate profile.

17. The bottomhole assembly as claimed in claim 1; wherein the second mandrel is disposed about the first mandrel.

18. The bottomhole assembly as claimed in claim 17; wherein the first mandrel is displaceable through the second mandrel.

19. The bottomhole assembly as claimed in claim 18, further comprising:

a fluid distributor including a fluid distributor housing configured for:

conducting material to and from a wellbore while the bottomhole assembly is disposed within the wellbore;

transmitting a force, being applied by the workstring, to the first mandrel for effecting the uphole and downhole displacements of the first mandrel;

wherein:

the first mandrel includes an outermost surface having a plurality of debris relief apertures extending through the outermost surface for communication with a passage disposed within the first mandrel;

the fluid distributor include a valve for effecting flow communication between the fluid distributor and the passage of the first mandrel;

the passage extends remotely of the fluid distributor relative to the first and second shifting tools; and the second mandrel includes debris relief apertures extending through an outermost surface of the second mandrel for communication with a space disposed between the second mandrel and the first mandrel; and one or more of the debris relief apertures of the first mandrel are disposed in alignment the space disposed between the second mandrel and the first mandrel.

20. A bottomhole assembly for deployment within a wellbore string disposed within a wellbore, the wellbore string including a port and a flow control member, wherein the flow control member is displaceable relative to the port for effecting opening and closing of the port, comprising:

a first mandrel;

a second mandrel including a locator for becoming disposed within a locate profile of the wellbore string such that resistance to displacement of the second mandrel, relative to the locate profile, is effected, and such that locating of the bottomhole assembly within the wellbore string is thereby effected;

a shifting tool including a first gripper surface and a second gripper surface;

a first shifting tool actuator, translatable with the first mandrel; and a second shifting tool actuator, translatable with the first mandrel;

wherein the second mandrel includes a retainer that co-operates with the shifting tool such that, while the locator is disposed within a locate profile:

displacement of the shifting tool, in response to urging by the first shifting tool actuator that is effected by downhole displacement of the first mandrel relative to the second mandrel, is with effect that the first gripper surface is displaced outwardly to a first gripper surface gripping position for becoming disposed in gripping engagement with the flow control member;

displacement of the shifting tool, in response to urging by the second shifting tool actuator that is effected by uphole displacement of the first mandrel relative to the second mandrel, is with effect that the second gripper surface is displaced outwardly to a second gripper surface gripping position for becoming disposed in gripping engagement with the flow control member.

21. The bottomhole assembly as claimed in claim 20; wherein the displacement of the shifting tool, for which the retainer is configured for limiting, is a displacement of the shifting tool along a longitudinal axis.

22. The bottomhole assembly as claimed in claim 20; wherein the displacement of the shifting tool, for which the retainer is configured for limiting, is a displacement relative to the second mandrel that is parallel or substantially parallel to the longitudinal axis of the second mandrel.

23. The bottomhole assembly as claimed in claim 22; wherein:

the downhole displacement of the first mandrel relative to the second mandrel, by which the urging of the first shifting tool actuator, in response to which the shifting tool is displaceable, is effectible, is a displacement of the first mandrel along its longitudinal axis in a first direction; and the uphole displacement of the first mandrel relative to the second mandrel, by which the urging of the second shifting tool actuator, in response to which the shifting tool is displaceable, is effectible, is a displacement of the first mandrel along its longitudinal axis in a second direction, wherein the second direction is opposite, or substantially opposite, to the first direction.

24. The bottomhole assembly as claimed in claim 23; wherein:

the outwardly displacement of the first gripper surface to the first gripper surface gripping position is outwardly relative to the first mandrel; and the outwardly displacement of the second gripper surface to the second gripper surface gripping position is outwardly relative to the first mandrel.

25. The bottomhole assembly as claimed in claim 24; wherein:

movement of the first gripper surface, during the outwardly displacement of the first gripper surface to the first gripper surface gripping position, includes a rotational component; and movement of the second gripper surface, during the outwardly displacement of the second gripper surface to the second gripper surface gripping position, includes a rotational component.

26. The bottomhole assembly as claimed in claim 24; wherein:

during the outwardly displacement of the first gripper surface to the first gripper surface gripping position, movement of the first gripper surface includes a rotational movement; and during the outwardly displacement of the second gripper surface to the first gripper surface gripping position, movement of the second gripper surface includes a rotational movement.

27. The bottomhole assembly as claimed in claim 26; wherein the rotational movement of the second gripper surface during the outwardly displacement of the second gripper surface to the second gripper surface gripping position is counter to the rotational movement of the first gripper surface during the outwardly displacement of the first gripper surface to the first gripper surface gripping position.

28. The bottomhole assembly as claimed in claim 26; wherein the shifting tool includes a rocker.

29. The bottomhole assembly as claimed in claim 28; wherein:

the displacement of the first gripper surface to the first gripper surface gripping position is such that the first gripper surface becomes disposed for transmitting a force to the flow control member for effecting downhole displacement of the flow control member relative to the port; and the displacement of the second gripper surface to the second gripper surface gripping position is such that the second gripper surface becomes disposed for transmitting a force to the flow control member for effecting uphole displacement of the flow control member relative to the port.

30. The bottomhole assembly as claimed in claim 29; wherein:

the first mandrel includes one of a pin and a j-slot;

the second mandrel includes the other one of the-pin and the j-slot, such that the second mandrel is coupled to the first mandrel via disposition of the pin within the j-slot;

the pin is movable within the j-slot;

engageablity of the first shifting tool actuator with the gripper, for effecting the outwardly displacement of the first gripper surface to the first gripper surface gripping position, is determined based upon positioning of the pin relative to the j-slot; and engageablity of the second shifting tool actuator with the gripper, for effecting the outwardly displacement of the second gripper surface to the second gripper surface gripping position, is determined based upon positioning of the pin relative to the j-slot.

31. The bottomhole assembly as claimed in claim 30; wherein, for at least one of the first and second gripper surfaces, the second mandrel includes an aperture through which a one of the at least one of the first and second gripper surfaces is displaceable in response to the urging by the respective one of the first and second shifting tools.

32. The bottomhole assembly as claimed in claim 31; wherein the shifting tool is translatable with the second mandrel.

33. The bottomhole assembly as claimed in claim 32; wherein the shifting tool is biased to the retracted position.

34. The bottomhole assembly as claimed in claim 33; wherein the shifting tool is supported on the first mandrel.

35. The bottomhole assembly as claimed in claim 34; wherein at least one of the first and the second shifting tool actuators is retained to the first mandrel by at least a shear pin.

36. The bottomhole assembly as claimed in claim 34; wherein;

the second mandrel includes a collet, wherein the locator is connected to the collet, the locator is configured for becoming disposed within the locate profile such that the disposition of the second mandrel within the locate profile is effected; and the collet is configured to exert a biasing force for urging the locator into disposition within the locate profile.

37. The bottomhole assembly as claimed in claim 34; wherein the debris relief apertures of the second mandrel are disposed in alignment with the shifting tool.

38. A bottomhole assembly for deployment within a wellbore string disposed within a wellbore, the wellbore string including a port and a flow control member, wherein the flow control member is displaceable relative to the port for effecting opening and closing of the port, comprising:

a shifting tool including a first gripper surface and a second gripper surface;

a first mandrel;

a first shifting tool actuator, translatable with the first mandrel; and a second shifting tool actuator, translatable with the first mandrel;

wherein the shifting tool is configured for retention to a wellbore feature such that the first mandrel becomes displaceable relative to the shifting tool, and while the shifting tool is retained to the wellbore feature:

the shifting tool is displaceable in response to urging by the first shifting tool actuator that is effected by downhole displacement of the first mandrel such that the first gripper surface is displaced outwardly to a first gripper surface gripping position for becoming disposed in gripping engagement with the flow control member; and the shifting tool is displaceable in response to urging by the second shifting tool actuator that is effected by uphole displacement of the first mandrel, such that the second gripper surface is displaced outwardly to a second gripper surface gripping position for becoming disposed in gripping engagement with the flow control member.

39. The bottomhole assembly as claimed in claim 38; wherein:

the outwardly displacement of the first gripper surface to the first gripper surface gripping position is outwardly relative to the first mandrel; and the outwardly displacement of the second gripper surface to the second gripper surface gripping position is outwardly relative to the first mandrel.

40. The bottomhole assembly as claimed in claim 39; wherein:

movement of the first gripper surface, during the outwardly displacement of the first gripper surface to the first gripper surface gripping position, includes a rotational component; and movement of the second gripper surface, during the outwardly displacement of the second gripper surface to the second gripper surface gripping position, includes a rotational component.

41. The bottomhole assembly as claimed in claim 40; wherein:

the downhole displacement of the first mandrel, by which the urging of the first shifting tool actuator, in response to which the shifting tool is displaceable, is effectible, includes displacement of the first mandrel along its longitudinal axis in a first direction; and the uphole displacement of the first mandrel, by which the urging of the second shifting tool actuator, in response to which the shifting tool is displaceable, is effectible, is a displacement of the first mandrel along its longitudinal axis in a second direction, wherein the second direction is opposite, or substantially opposite, to the first direction.

42. The bottomhole assembly as claimed in claim 41; wherein the shifting tool is supported on the first mandrel.

43. The bottomhole assembly as claimed in claim 38; wherein:

during the outwardly displacement of the first gripper surface to the first gripper surface gripping position, movement of the first gripper surface includes a rotational movement; and during the outwardly displacement of the second gripper surface to the first gripper surface gripping position, movement of the second gripper surface includes a rotational movement.

44. The bottomhole assembly as claimed in claim 43; wherein the rotational movement of the second gripper surface during the outwardly displacement of the second gripper surface to the second gripper surface gripping position is counter to the rotational movement of the first gripper surface during the outwardly displacement of the first gripper surface to the first gripper surface gripping position.

45. The bottomhole assembly as claimed in claim 38; wherein the shifting tool includes a rocker.

46. The bottomhole assembly as claimed in claim 45; wherein:

the first gripper surface is disposed closer to one end of the rocker relative to a second opposite end of the rocker; and the second gripper surface is disposed closer to the second end of the rocker relative to the first end.

47. The bottomhole assembly as claimed in claim 38; wherein:

the displacement of the first gripper surface to the first gripper surface gripping position is such that the first gripper surface becomes disposed for transmitting a force to the flow control member for effecting downhole displacement of the flow control member relative to the port; and the displacement of the second gripper surface to the second gripper surface gripping position is such that the second gripper surface becomes disposed for transmitting a force to the flow control member for effecting uphole displacement of the flow control member relative to the port.

48. The bottomhole assembly as claimed in claim 38; wherein the shifting tool is biased to the retracted position.

49. The bottomhole assembly as claimed in claim 38, further comprising:

a second mandrel including a locator for becoming disposed within a locate profile of the wellbore string such that resistance to displacement of the second mandrel, relative to the locate profile, is effected, and such that locating of the bottomhole assembly within the wellbore string is thereby effected;

wherein:

the second mandrel is co-operatively configured with at least the first and second shifting tool actuators such that:

the displaceability of the shifting tool, in response to the urging by the first shifting tool actuator that is effected by downhole displacement of the first mandrel, wherein the downhole displacement of the first mandrel is relative to the second mandrel, is such that downhole displacement of the shifting tool, relative to the second mandrel, is limited; and the displaceability of the shifting tool, in response to the urging by the second shifting tool actuator that is effected by uphole displacement of the first mandrel, wherein the downhole displacement of the first mandrel is relative to the second mandrel, is such that uphole displacement of the shifting tool, relative to the second mandrel, is limited.

50. The bottomhole assembly as claimed in claim 49; wherein the shifting tool is translatable with the second mandrel.

51. The bottomhole assembly as claimed in claim 49; wherein:

the first mandrel includes one of a pin and a j-slot;

the second mandrel includes the other one of the-pin and the j-slot, such that the second mandrel is coupled to the first mandrel via disposition of the pin within the j-slot;

the pin is movable within the j-slot;

engageablity of the first shifting tool actuator with the gripper, for effecting the outwardly displacement of the first gripper surface to the first gripper surface gripping position, is determined based upon positioning of the pin relative to the j-slot; and engageablity of the second shifting tool actuator with the gripper, for effecting the outwardly displacement of the second gripper surface to the second gripper surface gripping position, is determined based upon positioning of the pin relative to the j-slot.

52. The bottomhole assembly as claimed in claim 49; wherein:

the downhole displacement of the shifting tool, for which the second mandrel is co-operatively configured with at least the first and second shifting tool actuators for limiting, is a longitudinal displacement relative to the second mandrel in a first direction;

the uphole displacement of the shifting tool, for which the second mandrel is co-operatively configured with at least the first and second shifting tool actuators for limiting, is a longitudinal displacement relative to the second mandrel in a second direction, wherein the second direction is opposite, or substantially opposite, to the first direction.

53. The bottomhole assembly as claimed in claim 49; wherein:

the downhole displacement of the shifting tool, for which the second mandrel is co-operatively configured with at least the first and second shifting tool actuators for limiting, is a displacement relative to the second mandrel in a first direction that is parallel or substantially parallel to the longitudinal axis of the second mandrel; and the uphole displacement of the shifting tool, for which the second mandrel is co-operatively configured with at least the first and second shifting tool actuators for limiting, is displacement relative to the second mandrel in a second direction that is parallel or substantially parallel to the longitudinal axis of the second mandrel, wherein the second direction is opposite, or substantially opposite, to the first direction.

54. The bottomhole assembly as claimed in claim 53; wherein;

the second mandrel includes a collet, wherein the locator is connected to the collet, the locator is configured for becoming disposed within the locate profile such that the disposition of the second mandrel within the locate profile is effected; and the collet is configured to exert a biasing force for urging the locator into disposition within the locate profile.

55. The bottomhole assembly as claimed in claim 54; wherein, for at least one of the first and second gripper surfaces, the second mandrel includes an aperture through which a one of the at least one of the first and second gripper surfaces is displaceable in response to the urging by the respective one of the first and second shifting tools.

56. The bottomhole assembly as claimed in claim 49; wherein the second mandrel is disposed about the first mandrel.

57. The bottomhole assembly as claimed in claim 56; wherein the second mandrel is disposed about the first mandrel.

58. The bottomhole assembly as claimed in claim 57, further comprising:

a fluid distributor including a fluid distributor housing configured for:

conducting material to and from a wellbore while the bottomhole assembly is disposed within the wellbore;

transmitting a force, being applied by the workstring, to the first mandrel for effecting the uphole and downhole displacements of the first mandrel;

wherein:

the first mandrel includes an outermost surface having a plurality of debris relief apertures extending through the outermost surface for communication with a passage disposed within the first mandrel;

the fluid distributor include a valve for effecting flow communication between the fluid distributor and the passage of the first mandrel;

the passage extends remotely of the fluid distributor relative to the first and second shifting tools; and the second mandrel includes debris relief apertures extending through an outermost surface of the second mandrel for communication with a space disposed between the second mandrel and the first mandrel; and one or more of the debris relief apertures of the first mandrel are disposed in alignment the space disposed between the second mandrel and the first mandrel.

59. The bottomhole assembly as claimed in claim 58; wherein the debris relief apertures of the second mandrel are disposed in alignment with the shifting tool.

60. The bottomhole assembly as claimed in claim 38, wherein the bottomhole assembly is deployable downhole within a wellbore with a workstring, further comprising:

a fluid distributor including a fluid distributor housing configured for:

conducting material to and from a wellbore while the bottomhole assembly is disposed within the wellbore;

transmitting a force, being applied by the workstring, to the first mandrel for effecting the uphole and downhole displacements of the first mandrel;

wherein:

the first mandrel includes an outermost surface having a plurality of debris relief apertures extending through the outermost surface for communication with a passage disposed within the first mandrel;

the fluid distributor include a valve for effecting flow communication between the fluid distributor and the passage of the first mandrel; and the passage extends remotely of the fluid distributor relative to the first and second shifting tools.

61. The bottomhole assembly as claimed in claim 60; wherein one or more of the debris relief apertures of the first mandrel are disposed in alignment with the shifting tool.

62. The bottomhole assembly as claimed in claim 60; wherein:

each one of first and second shifting tool actuators, independently, is mounted to the first mandrel;

at least one of the first and second shifting tool actuators includes debris relief apertures extending through an outermost surface of the at least one of the first and second shifting tool actuators for communication with a space disposed between the at least one of the first and second shifting tool actuators and the first mandrel; and one or more of debris relief apertures of the first mandrel are disposed in alignment with the space disposed between the at least one of the first and second shifting tool actuators and the first mandrel.

63. The bottomhole assembly as claimed in claim 38; wherein at least one of the first and the second shifting tool actuators is retained to the first mandrel by at least a shear pin.

64. A method of treating a subterranean formation comprising:

deploying a bottomhole assembly within a wellbore string dispose within the wellbore, the wellbore string including a port and a flow control member, wherein the flow control member is displaceable relative to the port for effecting opening and closing of the port, including:

a mandrel, a shifting tool including a first gripper surface and a second gripper surface;

a first shifting tool actuator, translatable with the mandrel; and a second shifting tool actuator, translatable with the mandrel;

wherein:

the shifting tool is actuatable in response to urging by the first shifting tool actuator that is effected by downhole displacement of the mandrel such that the first gripper surface becomes disposed in gripping engagement with the flow control member; and the shifting tool is actuatable in response to urging by the second shifting tool actuator that is effected by uphole displacement of the mandrel such that the second gripper surface becomes disposed in gripping engagement with the flow control member;

actuating the shifting tool such that the first gripper surface becomes disposed in gripping engagement with the flow control member;

displacing the flow control member in a downhole direction relative to the port with the first gripper surface while the first gripper surface is disposed in gripping engagement with the flow control member, such that the port becomes opened;

supplying treatment material into the subterranean formation via the opened port;

after the supplying of the treatment material, actuating the shifting tool such that the second gripper surface becomes disposed in gripping engagement with the flow control member;

displacing the flow control member relative to the port in an uphole direction with the second gripper surface while the second gripper surface is disposed in gripping engagement with the flow control member, such that the port becomes closed; and after the closing of the port, shearing the second shifting tool actuator from the mandrel.

65. The method as claimed in claim 64, further comprising, after the shearing of the second shifting tool actuator:

actuating the shifting tool such that the first gripper surface becomes disposed in gripping engagement with the flow control member;

displacing the flow control member in a downhole direction with the second gripper surface that is disposed in gripping engagement with the flow control member, such that the port becomes opened; and producing hydrocarbon material from the subterranean formation via the opened port.

66. The method as claimed in claim 64, further comprising:

prior to the displacing of the flow control member in an uphole direction for effecting the closing of the port, retracting the first gripper surface from the flow control member.

67. A bottomhole assembly for deployment within a wellbore string disposed within a wellbore, the wellbore string including a port and a flow control member, wherein the flow control member is displaceable relative to the port for effecting opening and closing of the port, comprising:

a first mandrel;

a second mandrel including a locator for becoming disposed within a locate profile of the wellbore string such that resistance to displacement of the second mandrel, relative to the locate profile, is effected, and such that locating of the second mandrel within the wellbore string is thereby effected;

a shifting tool including a gripper;

a first shifting tool actuator, translatable with the first mandrel; and a second shifting tool actuator, translatable with the first mandrel;

wherein the shifting tool is co-operatively disposed relative to the second mandrel such that while the locator is disposed within a locate profile:

displacement of the shifting tool, in response to urging by the first shifting tool actuator that is effected by downhole displacement of the first mandrel relative to the second mandrel, is with effect that the gripper is displaced outwardly to a first gripping position for becoming disposed in gripping engagement with the flow control member and oriented for transmitting a force to the flow control member for effecting downhole displacement of the flow control member relative to the port; and displacement of the shifting tool, in response to urging by the second shifting tool actuator that is effected by uphole displacement of the first mandrel relative to the second mandrel, is with effect that the gripper is displaced outwardly to a second gripping position for becoming disposed in gripping engagement with the flow control member and oriented for transmitting a force to the flow control member for effecting uphole displacement of the flow control member relative to the port.

68. The bottomhole assembly as claimed in claim 67; wherein:

the outwardly displacement of the gripper to the first gripping position is outwardly relative to the first mandrel; and the outwardly displacement of the gripper to the second gripping position is outwardly relative to the first mandrel.

69. The bottomhole assembly as claimed in claim 68; wherein:

movement of the gripper, during the outwardly displacement of the surface to the first gripping position, includes a rotational component; and movement of the gripper, during the outwardly displacement of the gripper to the second gripping position, includes a rotational component.

70. The bottomhole assembly as claimed in claim 68; wherein:

during the outwardly displacement of the gripper to the first gripping position, movement of the gripper includes a rotational movement; and during the outwardly displacement of the gripper to the second gripping position, movement of the second gripper surface includes a rotational movement.

71. The bottomhole assembly as claimed in claim 70; wherein the rotational movement of the gripper during the outwardly displacement of the gripper to the second gripping position is counter to the rotational movement of the gripper during the outwardly displacement of the gripper to the first gripping position.

72. The bottomhole assembly as claimed in claim 67; wherein the shifting tool includes a rocker.

73. The bottomhole assembly as claimed in claim 67; wherein:

the downhole displacement of the first mandrel relative to the second mandrel, by which the urging of the first shifting tool actuator is effectible, is a displacement of the first mandrel along a longitudinal axis in a first direction; and the uphole displacement of the first mandrel relative to the second mandrel, by which the urging of the second shifting tool actuator is effectible, is a displacement of the first mandrel along a longitudinal axis in a second direction, wherein the second direction is opposite, or substantially opposite, to the first direction.

74. The bottomhole assembly as claimed in claim 73; wherein the second mandrel includes a retainer that prevents, or substantially prevents, translation of the shifting tool with the first mandrel while the locator is disposed within the locate profile.

75. The bottomhole assembly as claimed in claim 67; wherein:

the first mandrel includes one of a pin and a j-slot;

the second mandrel includes the other one of the-pin and the j-slot, such that the second mandrel is coupled to the first mandrel via disposition of the pin within the j-slot;

the pin is movable within the j-slot;

engageablity of the first shifting tool actuator with the gripper, for effecting the outwardly displacement of the gripper to the first gripping position, is determined based upon positioning of the pin relative to the j-slot; and engageablity of the second shifting tool actuator with the gripper, for effecting the outwardly displacement of the gripper to the second gripping position, is determined based upon positioning of the pin relative to the j-slot.

76. The bottomhole assembly as claimed in claim 67; wherein, the second mandrel includes a communicator through which the gripper is displaceable into the gripping engagement in response to the urging by the respective one of the first and second shifting tools.

77. The bottomhole assembly as claimed in claim 67; wherein the shifting tool is translatable with the second mandrel.

78. The bottomhole assembly as claimed in claim 67; wherein the shifting tool is biased to the retracted position.

79. The bottomhole assembly as claimed in claim 67; wherein the shifting tool is supported on the first mandrel.

80. The bottomhole assembly as claimed in claim 67; wherein at least one of the first and the second shifting tool actuators is retained to the first mandrel by a frangible member.

81. The bottomhole assembly as claimed in claim 67; wherein;

the second mandrel includes a collet, wherein the locator is connected to the collet, the locator is configured for becoming disposed within the locate profile such that the disposition of the second mandrel within the locate profile is effected; and the collet is configured to exert a biasing force for urging the locator into disposition within the locate profile.

82. A bottomhole assembly for deployment within a wellbore string disposed within a wellbore, the wellbore string including a port and a flow control member, wherein the flow control member is displaceable relative to the port for effecting opening and closing of the port, comprising:

a first mandrel;

a second mandrel including a locator for becoming disposed within a locate profile of the wellbore string such that resistance to displacement of the second mandrel, relative to the locate profile, is effected, and such that locating of the second mandrel within the wellbore string is thereby effected;

a shifting tool including a gripper, and translatable within the second mandrel;

a first shifting tool actuator, translatable with the first mandrel; and a second shifting tool actuator, translatable with the first mandrel;

wherein the shifting tool is co-operatively disposed relative to the second mandrel such that, while the locator is disposed within a locate profile:

displacement of the shifting tool, in response to urging by the first shifting tool actuator that is effected by downhole displacement of the first mandrel relative to the second mandrel, is with effect that the gripper is displaced outwardly to a first gripping position for becoming disposed in gripping engagement with the flow control member and oriented for transmitting a force to the flow control member for effecting downhole displacement of the flow control member relative to the port; and displacement of the shifting tool, in response to urging by the second shifting tool actuator that is effected by uphole displacement of the first mandrel relative to the second mandrel, is with effect that the gripper is displaced outwardly to a second gripping position for becoming disposed in gripping engagement with the flow control member and oriented for transmitting a force to the flow control member for effecting uphole displacement of the flow control member relative to the port;

wherein:

the outwardly displacement of the gripper to the first gripping position is outwardly relative to the first mandrel, and during the outwardly displacement of the gripper to the first gripping position, movement of the gripper includes a rotational movement; and the outwardly displacement of the gripper to the second gripping position is outwardly relative to the first mandrel, and during the outwardly displacement of the gripper to the second gripping position, movement of the gripper includes a rotational movement;

the rotational movement of the gripper during the outwardly displacement of the gripper to the second gripping position is counter to the rotational movement of the gripper during the outwardly displacement of the gripper to the first gripping position;

the downhole displacement of the first mandrel relative to the second mandrel, by which the urging of the first shifting tool actuator is effectible, is a displacement of the first mandrel along a longitudinal axis in a first direction; and the uphole displacement of the first mandrel relative to the second mandrel, by which the urging of the second shifting tool actuator is effectible, is a displacement of the first mandrel along a longitudinal axis in a second direction, wherein the second direction is opposite, or substantially opposite, to the first direction.

83. The bottomhole assembly as claimed in claim 82; wherein the second mandrel includes a retainer that prevents, or substantially prevents, translation of the shifting tool with the first mandrel while the locator is disposed within the locate profile.

84. The bottomhole assembly as claimed in claim 83; wherein the second mandrel includes a communicator through which the gripper is displaceable in response to the urging by the respective one of the first and second shifting tools.

85. The bottomhole assembly as claimed in claim 84; wherein the second mandrel includes a communicator through which the gripper is displaceable in response to the urging by the respective one of the first and second shifting tools.

86. The bottomhole assembly as claimed in claim 85; wherein the shifting tool is biased to the retracted position.

87. The bottomhole assembly as claimed in claim 86; wherein;

the second mandrel includes a locator and a collet, wherein the locator is connected to the collet, the locator is configured for becoming disposed within the locate profile such that the disposition of the second mandrel within the locate profile is effected; and the collet is configured to exert a biasing force for urging the locator into disposition within the locate profile.

88. The bottomhole assembly as claimed in claim 87; wherein:

the first mandrel includes one of a pin and a j-slot;

the second mandrel includes the other one of the pin and the j-slot, such that the second mandrel is coupled to the first mandrel via disposition of the pin within the j-slot;

the pin is movable within the j-slot;

engageablity of the first shifting tool actuator with the gripper, for effecting the outwardly displacement of the gripper to the first gripping position, is determined based upon positioning of the pin relative to the j-slot; and engageablity of the second shifting tool actuator with the gripper, for effecting the outwardly displacement of the gripper to the second gripping position, is determined based upon positioning of the pin relative to the j-slot.

* * * * *